US005544466A

United States Patent [19]

Bonnet

[11] Patent Number: 5,544,466

[45] **Date of Patent: *Aug. 13, 1996**

[54] METHOD AND APPARATUS FOR LOADING AND CLOSING A CONTAINER

[75] Inventor: Henri Bonnet, Atlanta, Ga.

[73] Assignee: United Parcel Service of America, Inc., Atlanta, Ga.

[ * ] Notice: The term of this patent shall not extend beyond the expiration date of Pat. No. 5,444,962.

[21] Appl. No.: 337,301

[22] Filed: Nov. 10, 1994

Related U.S. Application Data

[63] Continuation-in-part of Ser. No. 195,875, Feb. 14, 1994, Pat. No. 5,444,962.

[51] Int. Cl.[6] ..... B65B 51/04

[52] U.S. Cl. ..... 53/138.7; 53/250; 53/253; 53/168

[58] Field of Search ..... 53/250, 253, 168, 53/583, 138.7, 138.3

[56] References Cited

U.S. PATENT DOCUMENTS

| | | | |
|---|---|---|---|
| 2,015,473 | 9/1935 | Hankel | 150/6 |
| 2,178,494 | 10/1939 | Richardson | 226/129 |
| 2,262,620 | 11/1941 | Neuman | 248/99 |
| 2,322,090 | 6/1943 | Hobbie | 226/58 |
| 2,639,069 | 5/1953 | West | 53/253 |
| 2,763,109 | 9/1956 | Baker | 53/138.7 |
| 3,097,459 | 7/1963 | Rausch | 53/59 |
| 3,375,634 | 4/1968 | Jarund | 53/139.1 |
| 3,384,134 | 5/1968 | Hillerne | 141/10 |
| 3,393,633 | 7/1968 | Hoffman et al. | 53/390 |
| 3,406,727 | 10/1968 | Rexus | 53/253 |
| 3,731,454 | 5/1973 | Crabb | 53/138.7 |
| 3,896,605 | 7/1975 | Chevalier | 53/284.7 |
| 4,162,602 | 7/1979 | Achelpohl et al. | 53/139.1 |
| 4,235,067 | 11/1980 | Parsons | 53/253 |
| 4,363,203 | 12/1982 | Marshall et al. | 53/168 |
| 4,648,233 | 3/1987 | Holland | 53/55 |
| 5,024,042 | 6/1991 | Meyer | 53/168 |

*Primary Examiner*—John Sipos
*Assistant Examiner*—Gene L. Kim
*Attorney, Agent, or Firm*—Jones & Askew

[57] ABSTRACT

A method for loading and closing containers, such as bags, with flexible open ends employs a chute with an inflatable bladder at the open end, and an elastic closure device. A flexible open end of the container is placed around the end of the chute and the inflatable bladder. The elastic closure device is placed around the open end of the container. The bladder is inflated to secure the container to the chute. Material is delivered into the container through the chute. When a specified quantity of material is loaded into the container, the bladder is deflated causing the container to slide off the chute. When the container slides off the chute, the elastic closure device contracts and closes the flexible open end of container by constricting the size of the flexible open end of the container such that material will not fall out during shipment. Multiple chutes may be supported on a moveable support structure and operated to provide a semi-automatic container loading and closing apparatus and method. The chutes may have a circular cross-sectional shape, or, alternatively, may have a rectangular cross-sectional shape, and in particular, a square cross-sectional shape. An alternate closure device adapted to a container adjacent the open end, provides a spring closure assembly, which includes opposed wire springs, for causing the container open end to form a rectangular, including a square, container opening when opened. A container incorporating a spring closure assembly is particularly suited for use with a chute having a rectangular cross-sectional shape.

24 Claims, 13 Drawing Sheets

METHOD AND APPARATUS FOR LOADING AND CLOSING A CONTAINER

BACKGROUND OF THE INVENTION

This is a continuation-in-part application of U.S. patent application Ser. No. 08/195,875, filed Feb. 14, 1994, by Henri Bonnet, entitled METHOD AND APPARATUS FOR LOADING AND CLOSING A CONTAINER, now U.S. Pat. No. 5,444,962.

1. Field of the Invention

The present invention relates to methods and apparatuses for loading and closing containers, and, in particular, to loading flexible containers with packages in the field of package shipping.

2. Description of the Related Art

In the field of package shipping, small packages heading to a common destination are often placed in flexible shipping containers for shipment. The process of filling shipping containers with packages manually is extremely labor intensive and, therefore, slow and expensive. Since competitiveness in the package shipping industry depends primarily on efficiency, it is preferable to automate this process. Conventional automatic material bagging systems are too large for use in the package shipping industry which might employ as many as 500 automatic baggers in a single facility. Thus, what is needed are simple, inexpensive, reliable, and compact methods and apparatuses for loading and closing shipping containers.

Accordingly, it is an object of this invention to overcome the disadvantages and drawbacks of the known art and to provide methods and apparatuses for loading and closing shipping containers.

It is a further object of this invention to provide a simple, inexpensive, and reliable apparatus for automating the loading and closing of shipping containers.

Further objects and advantages of this invention will become apparent from the detailed descriptions of alternative preferred embodiments which follow.

SUMMARY OF THE INVENTION

The present invention is an apparatus for loading and closing a container having a flexible open end. It is especially useful as part of a system for sorting and bagging small parcels. In a first alternative embodiment the apparatus comprises a chute having an open end, a retaining device, preferably an inflatable bladder disposed around the open end of the chute, and an elastic closure device placeable around the open end of the container. The flexible open end of the container is disposed in supported engagement with the chute by causing the container open end to be placed about the chute open end, covering the bladder, and then inflating the bladder so that the bladder engages an inner surface of the container thereby supporting the container. An elastic closure device is placed about the container adjacent the open end and below a lower edge of the bladder. The elastic closure device closes the open end of the container after the container slides off the open end of the chute.

In a second alternative embodiment, the present invention includes an apparatus for loading and closing a container having a flexible open end, comprising a plurality of chutes supported by a movable support frame which is movable to position, sequentially, each of the plurality of chutes relative to a material source, to receive material from the material source. The movable support frame is translated in a horizontal plane. The open end of one of the containers is disposed about each of the chute open ends and held in engagement there by an inflatable bladder disposed around the chute open end. A closure device is then engaged about the container open end. When the container is full the bladder is caused to deflate and the container falls from the chute onto a conveyor below the chute, for example. As the container falls the closure device closes the container so that the contents will be retained within the container. The support frame is then indexed so as to allow a second container attached to a second of the plurality of chutes to be filled with material.

In a third alternative embodiment, the present invention includes an apparatus for loading and closing a container having a flexible open end, comprising a plurality of chutes extending radially from a drum which is caused to rotate in a vertical plane about a horizontal axis. A bladder, for supporting a container about a chute, is disposed about each of the chutes. One of the plurality of chutes acts as a conduit to receive material to be loaded from a material source and to pass it into the drum. The other chutes are provided with containers supported about the chute by bladders which have been inflated and act to receive the material passed into the drum. Drum interior surfaces are shaped to cause the material passed into the drum to pass to a downwardly oriented chute and into a container supported by the chute. After the container is filled, the bladder supporting the filled container is deflated and the filled container drops to the conveyor. The filled container is closed automatically as described above. The drum is then rotated to place another chute, supporting a container, in the downwardly oriented position to receive material from the material source, and to place another of the chutes, not supporting a container, in position to act as a conduit to direct material from the material source into the drum.

In a second configuration of any of the embodiments of the present invention, chutes having a rectangular transverse cross-section are extended from the support frame. A bladder is disposed about the outer surface of the rectangular chute and containers are supported from the rectangular chute by the bladder. The containers are provided with a spring closure device that allows the container open end to assume a rectangular opening when the spring closure device is urged open. The rectangular shaped open end of the container fits over the deflated bladder disposed about the chute. When the bladder is inflated the protuberant portion of the bladder engages interior portions of the container to support the container about the rectangular chute. When the container is filled and the bladder deflated, the container drops off the chute and the spring closure device springs shut to close the container.

In another configuration, the chute is provided with a mechanical retainer instead of a bladder for retaining a container about the chute open end. In one embodiment the retainer comprises a pivotally mounted retaining arm having an engaging end capable of engaging portions of the container. The engaging end may include a bumper for exerting a supporting force against the upper portion of the container and against the chute, adjacent the container open end. In an alternative embodiment of a mechanical retainer, the engaging end may include an engaging hook which is particularly well suited for engaging portions of a container incorporating a spring closure device for closing the container open end.

The present invention also provides a method for loading and closing a container having a flexible open end. According to this method, the open end of the container is placed around an inflatable bladder, the bladder being disposed around an open end of a chute. The bladder is then inflated to secure the container to the chute and an elastic closure device is placed around a portion of the open end of the container disposed about the chute. Material is then delivered through the chute into the container. The bladder is then deflated to release the container from the chute, whereby the container slides off the end of the chute and the elastic closure device closes the open end of the container.

The present invention also includes a method for loading and closing a container having a flexible open end used with an apparatus of the present invention which comprises a plurality of chutes supported by a translatable support frame, or a rotatable drum, which is movable to position, sequentially, each of the plurality of chutes relative to a material source to receive material from the material source. According to this method, open ends of containers are placed about chute open ends and the bladders, disposed about the chute open ends, are then inflated to secure the containers to the chutes. A closure device is placed around a portion of the open end of the containers disposed about the chute. Material is then delivered through one of the chutes and into the container disposed about that chute. When the container is full, the bladder is then deflated to release the container from the chute, whereby the container slides off the end of the chute and the closure device closes the open end of the container. The movable frame or rotatable drum is then moved to dispose a second chute of the plurality of chutes in registration with the material source. Material is delivered through the second chute into the second container. The bladder associated with the second chute is then deflated to release the second container from the chute, whereby the second container slides off the end of the second chute and the closure device closes the open end of the second container. At this point, or while the second container is being filled, the open end of an empty container is placed around the open end of the chute that had previously been in position to receive material.

Thus, the process of filling a container and indexing to another container disposed about another chute supported by a common support frame is repeated. Preferably, the filling process is initiated only when it is determined that a container is present. This may be determined by monitoring when the bladders are inflated. Alternatively, a detector may be provided to detect the presence of a container about the open end of a chute so that an associated package routing system can route packages to the chute only if the chute has a container disposed about it.

DETAILED DESCRIPTION OF THE PREFERRED EMBODIMENTS

Figure 1:
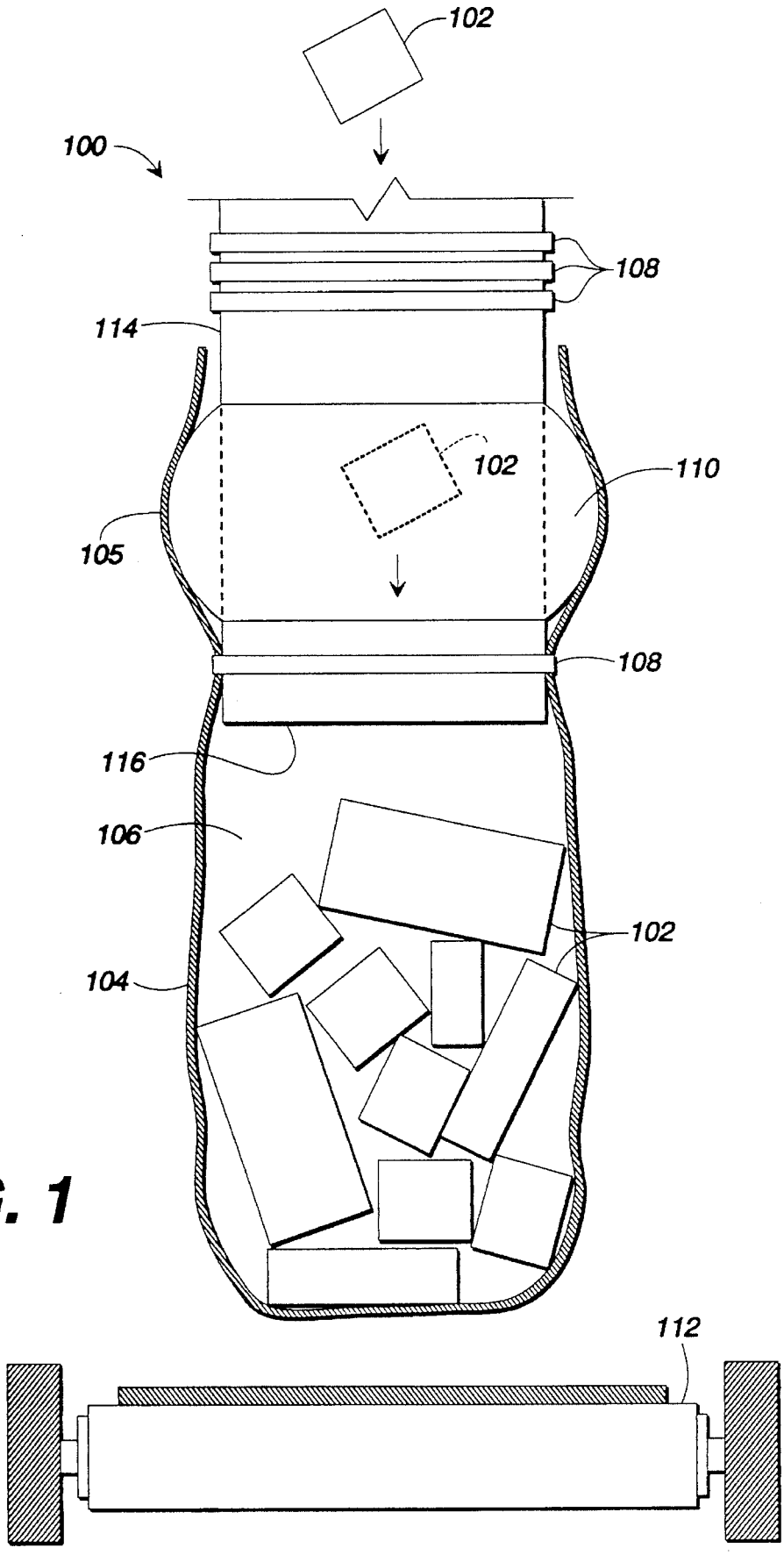
FIG. 1 is a schematic side view of an apparatus for loading and closing a container with a flexible open end according to a preferred embodiment of the present invention.

Referring now to FIG. 1, there is shown a schematic side view of a loading and closing apparatus 100 for loading and closing a container 104 with a flexible open end 105, according to a preferred embodiment of the present invention. Apparatus 100 comprises a generally cylindrical chute 114 having an open end 116, an inflatable bladder 110, an elastic closure device 108, and a conveyor 112.

Chute 114 is the conduit for material, shown here as packages 102, that may be delivered into container 104. Inflatable bladder 110 is disposed circumferentially around and attached to the exterior surface of chute 114 near open end 116 of chute 114. Bladder 110 is a generally toroidal air-tight sleeve that expands when inflated with air and returns to its original size when deflated. Bladder 110 is made of an air-tight material such as rubber. Bladder 110 is attached to chute 114 by suitable fastening means, such as glue, which does not breach the air-tight seal of the bladder. When bladder 110 is deflated, open end 105 of container 104 can pass freely over chute 114 and bladder 110. When bladder 110 is inflated, it exerts outward pressure on the inner walls of container 104 thereby securing container 104 to chute 114. The diameter of bladder 110 when inflated is selected to be sufficiently great to secure container 104 to chute 114 when container 104 is loaded with packages.

Figure 2:
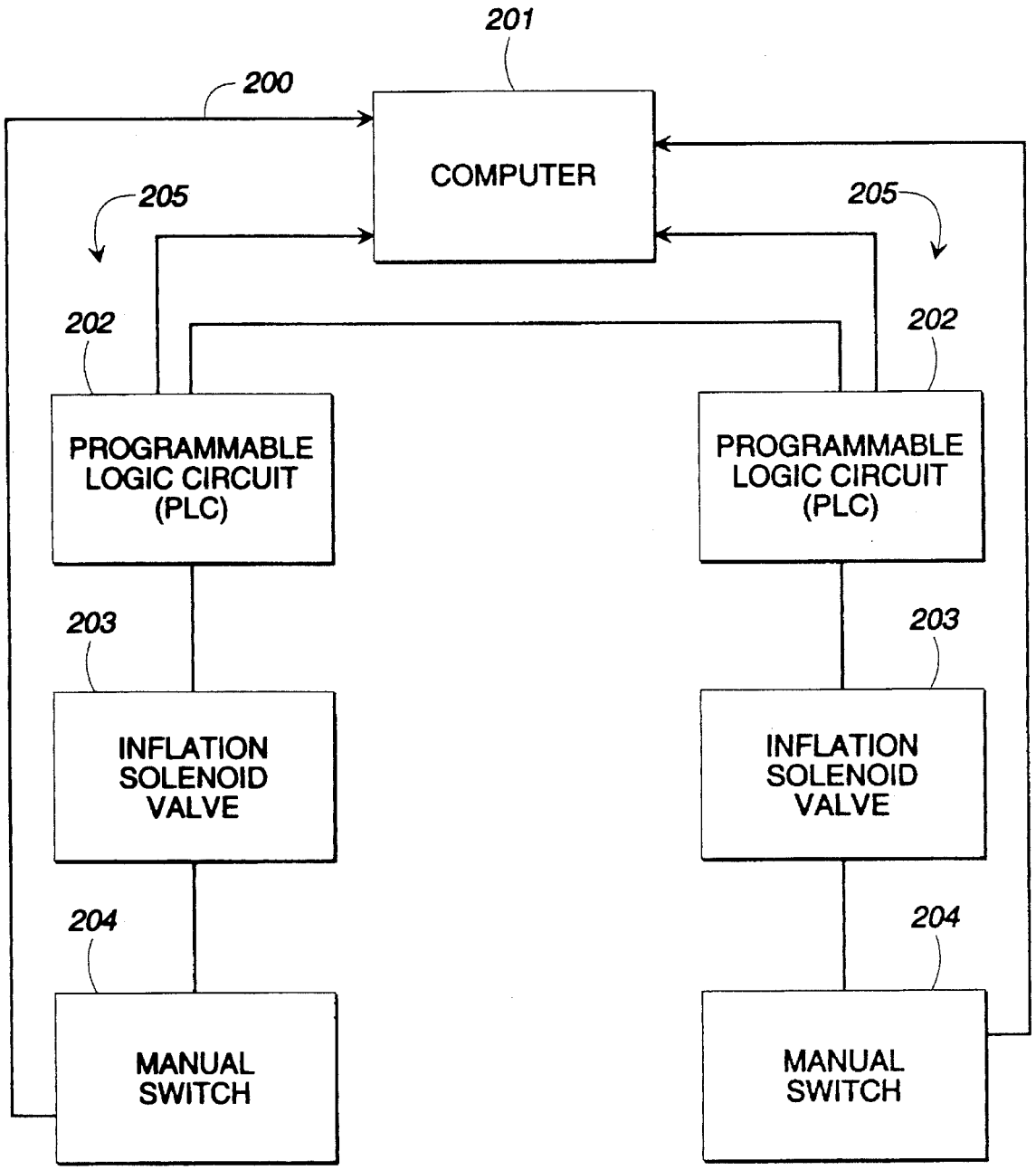
FIG. 2 is a block diagram of a control system for controlling the apparatus of FIG. 1.

Referring now to FIG. 2, there is shown a block diagram of a control system 200 having a plurality of control branches 205 for controlling the operations of a plurality of apparatuses 100 of FIG. 1 in conjunction with a system for sorting packages. Those skilled in the art will understand that the system may be any suitable system for sorting packages, such as an SBIR package sorting system sold by CML Corporation of Italy or a tilt-tray system sold by Logan corporation. With regards to the apparatus 100, the control system 200 comprises a computer 201 controlling each of a plurality of control branches for controlling an apparatus 100. Each control branch 205 includes a programmable logic controller (PLC) 202, a two-position inflation solenoid valve 203, and a manual switch 204. Computer 201 of control system 200 controls the delivery of packages through a plurality of chutes 114 of FIG. 1. In a preferred embodiment, computer 201 is a microprocessor-based personal computer programmed to route packages 102 to the appropriate chutes 114, count the number of packages 102 delivered to each chute 114 so that the containers 104 are filled to a desired level in the container 104, stop the routing of packages 102 to chute 114 when a specified number of packages 102 has been delivered to that chute 114, and deflate bladder 110 of the corresponding chute 114. It should be understood that other routing methods and apparatus configurations may be used to detect the volume of packages delivered to the containers 104 so that the containers are filled to a desired level. For example, rather than counting the number of packages delivered to a chute 114 and container 104, the volume of packages en route to a chute 114 may be measured and accumulated in real time, and when the accumulated measured volume of packages reaches a predetermined volume value, a message may be generated by the computer to stop routing packages to the chute 114. Alternatively, the weight of each package en route to the chute 114 may be measured and the weight measurements accumulated. When the accumulated weight reaches a predetermined weight, the routing may be stopped in response to a computer message. Also, means may be provided for detecting the absolute level of packages 102, in situ, in a container 104 supported about a chute 114 while it is being filled, and then sending a responsive message to the computer 201 to stop routing packages to the container.

For each chute 114 controlled by computer 201, computer 201 is connected to a PLC 202, which is preferably a standard industrial computer manufactured by, for example, Allen Bradley, General Electric, Siemans, or Mitsubishi. PLC 202 is connected to the two-position solenoid valve 203 and signals the solenoid valve 203 to deflate the bladder 110 of apparatus 100 of FIG. 1 when a corresponding signal from the computer 201 is received.

The two-position solenoid valve 203 directly controls the inflation and deflation of bladder 110. The solenoid valve is mechanically connected to a pressurized air supply (not shown) and to the interior of the bladder 110. When the solenoid valve 203 is in the closed position, the interior of the bladder 110 is closed to the environment and open to the pressurized air supply, thereby causing the bladder 110 to inflate. When the solenoid valve 203 is in the open position, the interior of the bladder 110 is open to the environment and closed to the pressurized air supply, thereby causing the bladder 110 to deflate. Those skilled in the art will understand that, if available, the pressurized air supply is preferably part of the package sorting system. A vacuum source may also be adapted to the bladder 110 so that the bladder can be deflated to a greater extent so as to reduce the protuberance of the bladder 110 from the chute 114.

The solenoid valve 203 is electrically connected to the PLC 202 and to the manual switch 204. The PLC 202 causes the solenoid valve 203 to open in response to an appropriate control signal received from the computer 201. The manual switch 204 may be manually triggered to cause the solenoid valve 203 to close. When the manual switch 204 closes the valve 203, a signal is sent to the computer 201 that the bladder 110 has been inflated thus providing an indication that a container 104 is present about the bladder 110. It is to be understood that other means may be employed to provide an indication of a container 104 present about a chute open end. For example, a photo-electric device may be arranged such that the presence of a container about a chute interrupts a light beam path of the photo-electric detector. Alternatively, a sonar device may be used to detect the presence of a container about a chute.

In a preferred embodiment, the valve 203 is a two position solenoid valve, such as those manufactured by Air Royal. Those skilled in the art will understand that means other than a two-position solenoid valve may be used to inflate and deflate the bladder 110.

Figure 3:
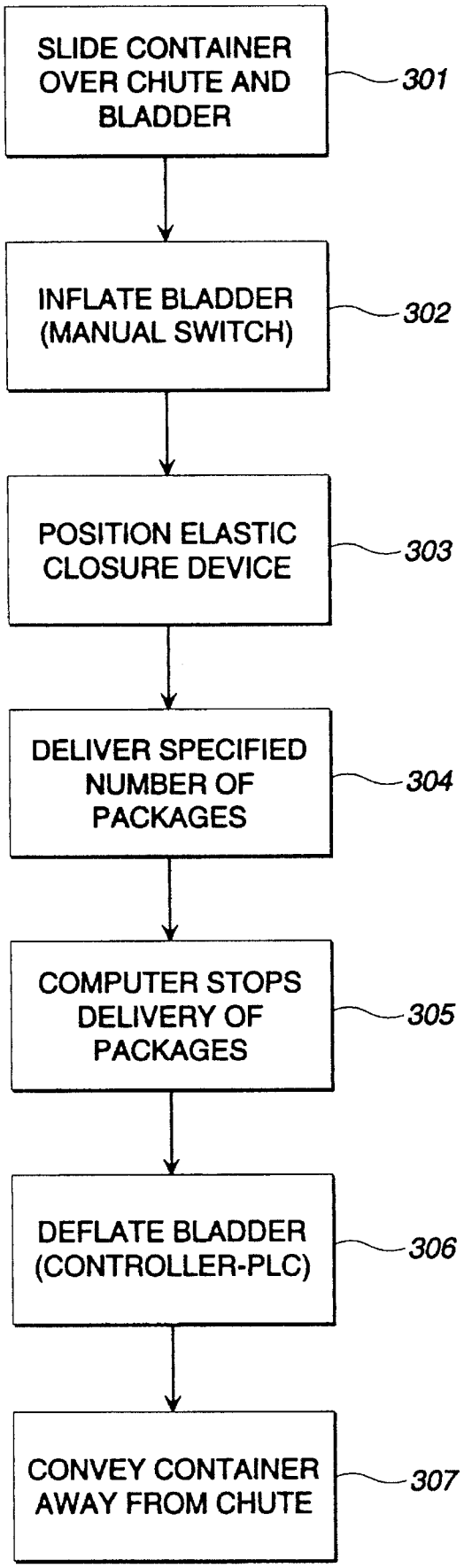
FIG. 3 is a process flow diagram for the apparatus of FIG. 1.

Referring now to FIG. 3, there is shown a process flow diagram of the operation of apparatus 100 of FIG. 1, according to a preferred embodiment of the present invention. At step 301, an operator slides flexible open end 105 of container 104 over open end 116 of chute 114 and over bladder 110 with bladder 110 in an uninflated state. At step 302, the operator triggers manual switch 204 of FIG. 2 to close solenoid valve 203, thereby causing the bladder 110 to inflate thereby securing container 104 to chute 114. When the manual switch 204 is used to close the valve 203, a signal is sent to the computer 201 that the bladder 110 has been inflated. At step 303, the operator moves one of the elastic closure devices 108 from the storage position above bladder 110 to a position below bladder 110 and around open end 105 of container 104.

At step 304, after the computer 201 receives the signal that the bladder 110 has been inflated, the computer 201 begins delivering packages 102 through chute 114 and into container 104. At step 305, computer 201 recognizes that the specified number (or volume, or weight) of packages 102 has been delivered to chute 114 and stops sending packages 102 to that chute 114. At step 306, computer 201 sends a signal to PLC 202 which in turn signals solenoid valve 203 to open, thereby causing bladder 110 to deflate allowing container 104 to slide off chute 114 onto conveyor 112. When container 104 slides off chute 114, elastic closure device 108 contracts and closes the flexible open end 105 of container 104. At step 307, conveyor 112 conveys closed container 104 away from open end 116 of chute 114.

Closure device 108 is, preferably, made of an elastic material in the form of a ring, such as rubber, the elasticity of which is sufficient to close flexible open end 105 of container 104 when container 104 slides off chute 114. Elastic closure device 108 preferably allows container 104 to slide off chute 114 when bladder 110 is deflated. Those skilled in the art will understand that the desired coefficient of expansion of elastic closure device 108 depends on the type of container 104 selected for use in apparatus 100. In a preferred embodiment, in which container 104 is a canvas bag, elastic closure device 108 is made from Kraton® rubber made by Shell Corporation and has a coefficient of expansion of approximately 1/1750. In a package delivery system, the degree of closure of the container needs only be sufficient to retain the packages or material within the container when the container is tipped, for example.

In a preferred embodiment of the present invention, elastic closure device 108 is disposed around flexible open end 105 of container 104 below bladder 110 but above the end of chute 114. As shown in FIG. 1, additional elastic closure devices 108 may be stored disposed around chute 114 above flexible open end 105 of container 104 for use with subsequent containers 104. In alternative embodiments of container 104, elastic closure device 108 may be built into container 104 by providing a hem about the flexible open end 105 of the container 104 and enclosing an elastic closure device 108 within the hem.

Conveyor 112 is disposed below chute 114. Conveyor 112 is as close as possible to the open end of chute 114 while allowing container 104 to hang from chute 114 without touching conveyor 112. As a result, when container 104 slides off chute 114, the risk of damage to packages 102 is minimized.

It will be understood by persons skilled in the art that computer 201 may be programmed to deliver a specified volume or weight of material to container 104 rather than a specified number of units. Alternatively, computer 201 may be programmed to deliver material for a specified period of time.

Figure 4A:
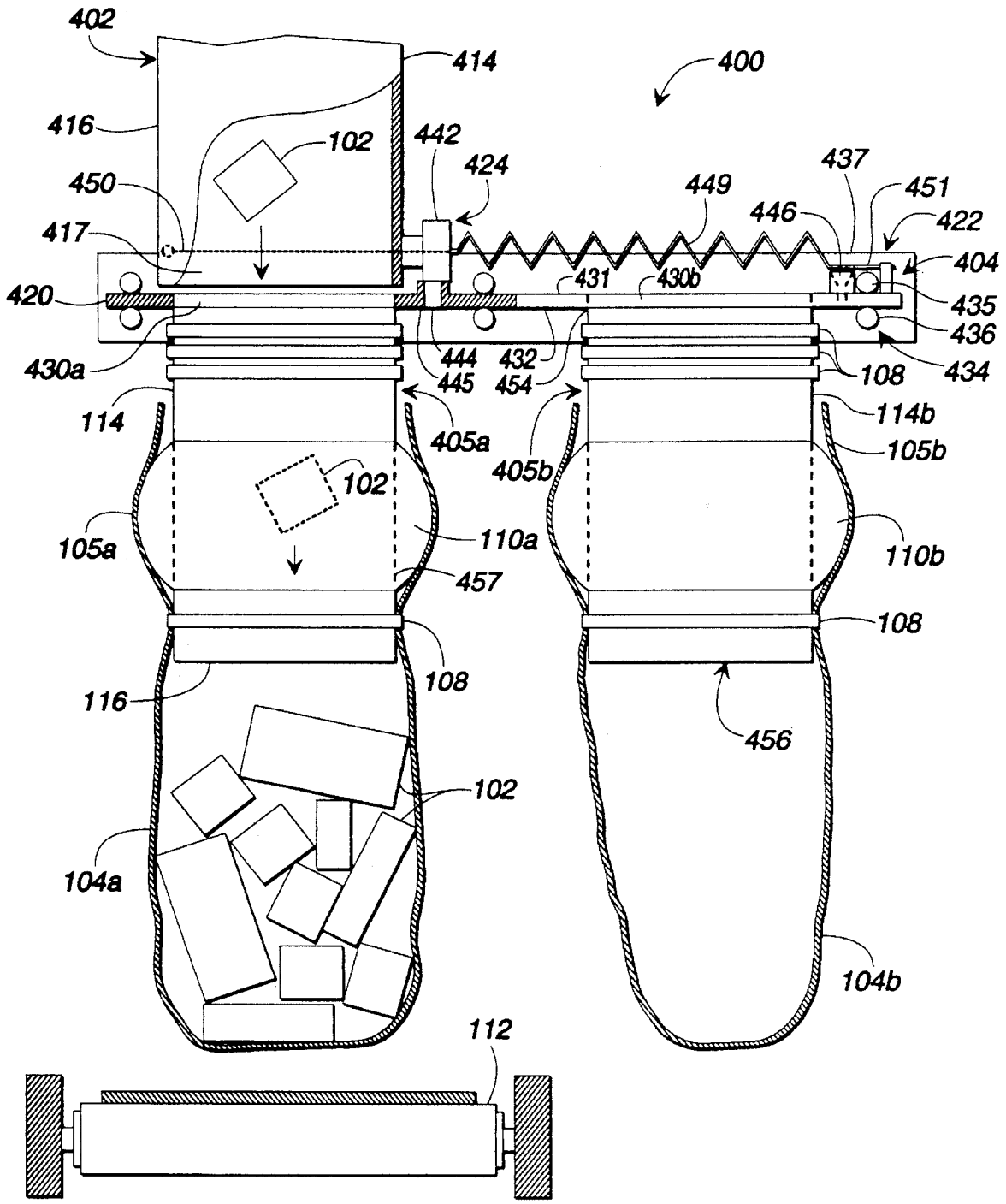
FIG. 4*a* is a side view shown in partial cross-section of a first alternative preferred embodiment of an apparatus for loading and closing a container with a flexible open end supported on a movable frame having a plurality of chutes translatable in a horizontal plane.
Figure 4B:
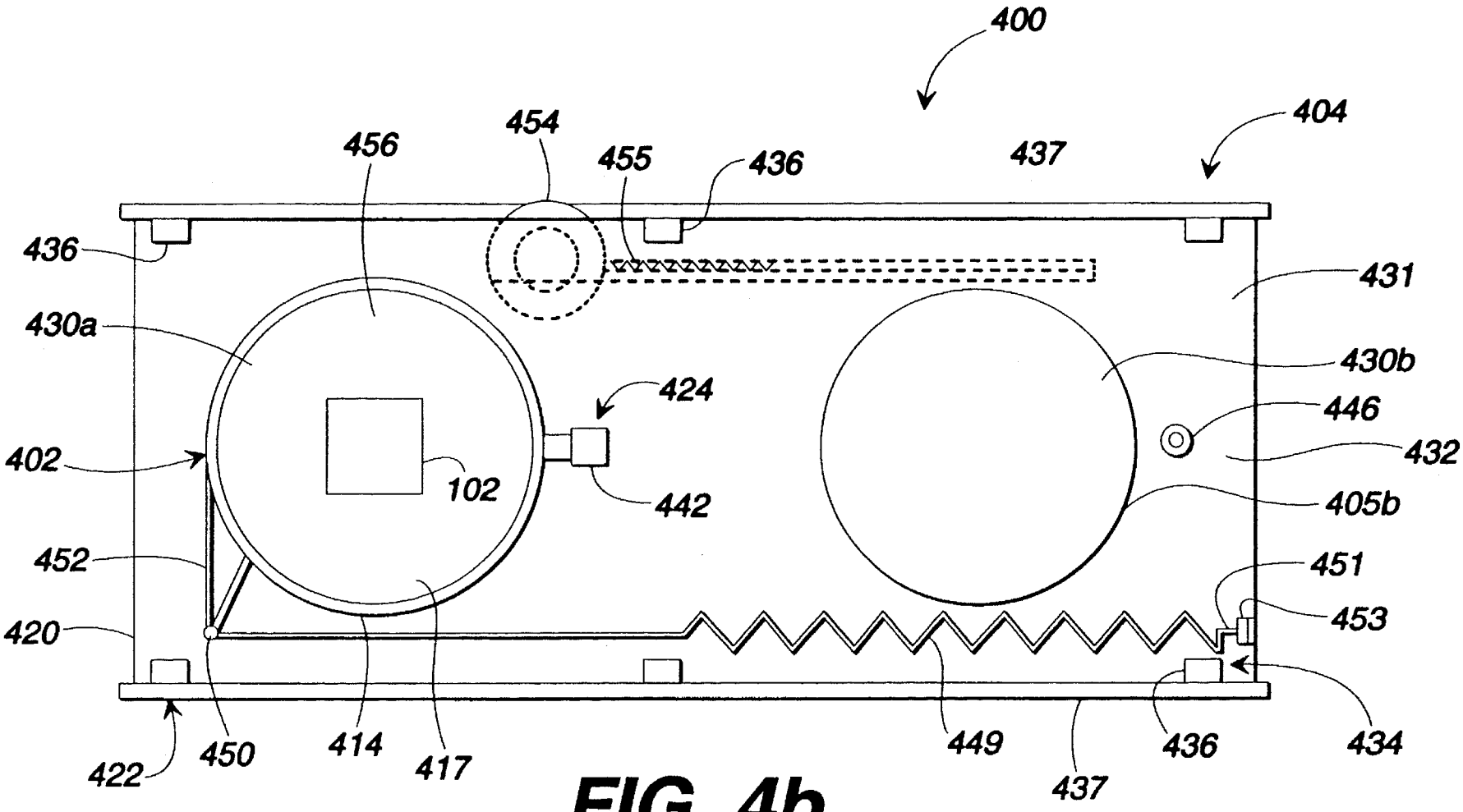
FIG. 4*b* is a top view shown in partial cross-section of the apparatus for loading and closing a container shown in FIG. 4.
Figure 11:
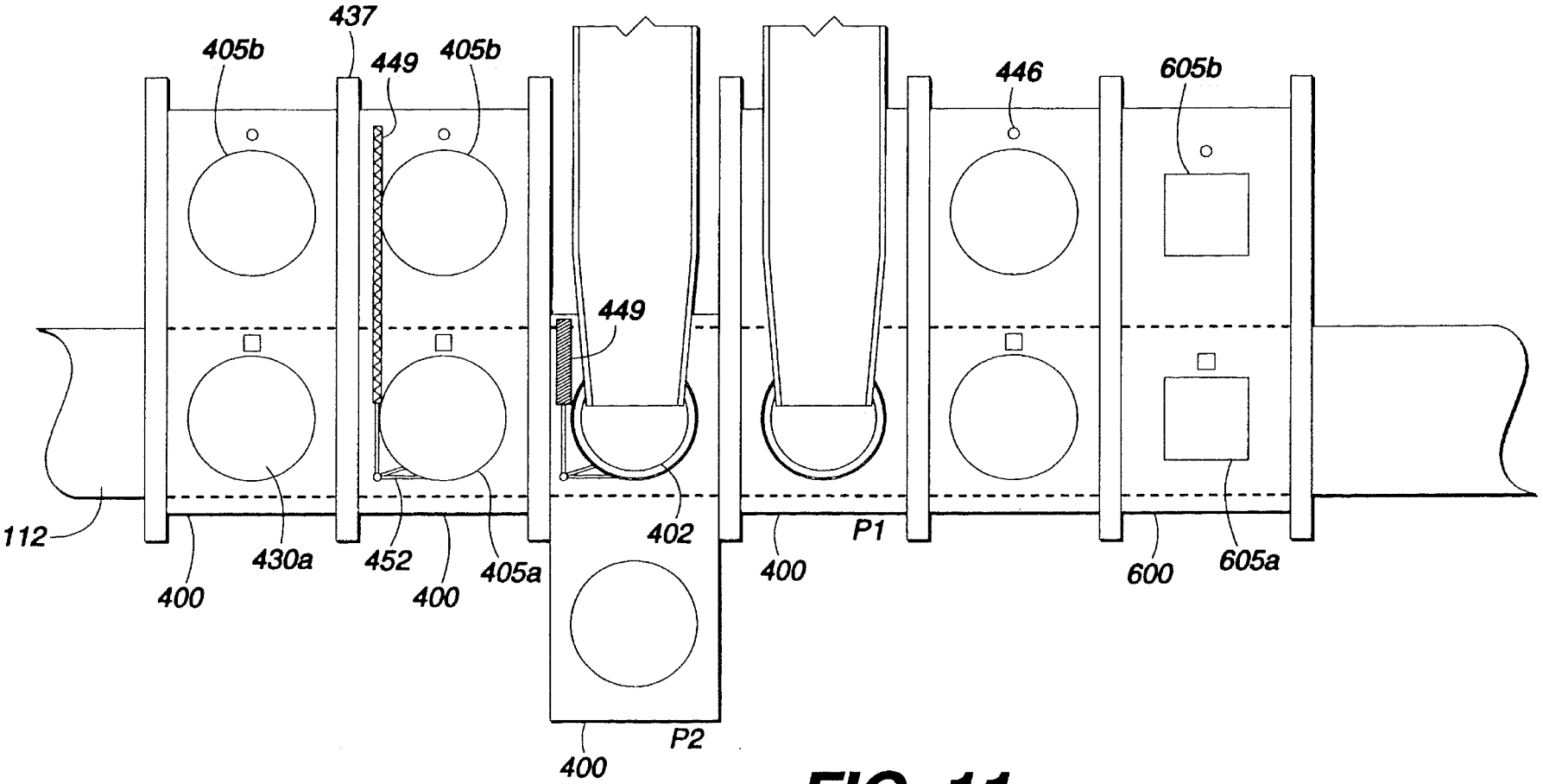
FIG. 11 is a schematic top view of a portion of a container loading and closing line of a material handling and shipping facility in which a plurality of apparatuses for loading and closing containers of the first alternative embodiment, shown in FIG. 4, are installed in a side-by-side configuration.

Looking now at FIGS. 4*a* and 4*b* there is shown a first configuration of a second alternative embodiment of a loading and closing apparatus 400 for loading material 102 delivered from a material source through a material chute assembly 402. The apparatus 400 includes a support frame and translation assembly 404 supporting a pair of container support chute assemblies 405*a* and 405*b*. Containers 104*a* and 104*b*, having container flexible open ends 105*a* and 105*b*, are disposed in supported engagement about the chute assemblies 405*a* and 405*b*, respectively. A conveyor 112 is positioned beneath the apparatus 400 adjacent the container 104*a*. A group of apparatuses 400, shown in a side-by-side, ganged installation as they would appear in a high volume material handling and shipping facility, is shown schematically in FIG. 11.

The material chute assembly 402 includes a tubular material chute 414 disposed in fixed relation to the conveyor 112. The material chute 414 is generally circular in cross-section and includes a material delivery end 416 which defines a material outlet opening 417. The material chute 414 acts to guide material such as packages 102, received from a material source (not shown), into one of the containers 104 which will be explained in more detail below.

The support frame and translation assembly 404 includes a generally rectangular support frame 420, supported in moving relation to the outlet end 416 of the material chute 414 by a translation support assembly 422. The support frame 420 defines a pair of adjacent material passageways 430*a* and 430*b* extending between upper and lower surfaces 431 and 432 of the support frame 420. The support frame 420 is capable of being moved from a first position $P_1$ to a second position $P_2$ such that, in position $P_1$ (shown in FIG. 11) the passageway 430*a* is disposed in registration with the outlet opening 417 of the material chute 414, and in position $P_2$ the passageway 430*b* is disposed in registration with the outlet opening 417 during material loading.

To facilitate movement between these positions, the translation support assembly 422 includes a plurality of support roller assemblies 434 comprising upper and lower rollers 435 and 436 attached to a support beams 437 extending along opposite sides of the frame 420. The upper and lower rollers 435 and 436 are disposed in supporting, rotational engagement with the upper and lower surfaces 431 and 432, respectively, of the support frame 420 along opposing edges of the frame 420.

Figure 2A:
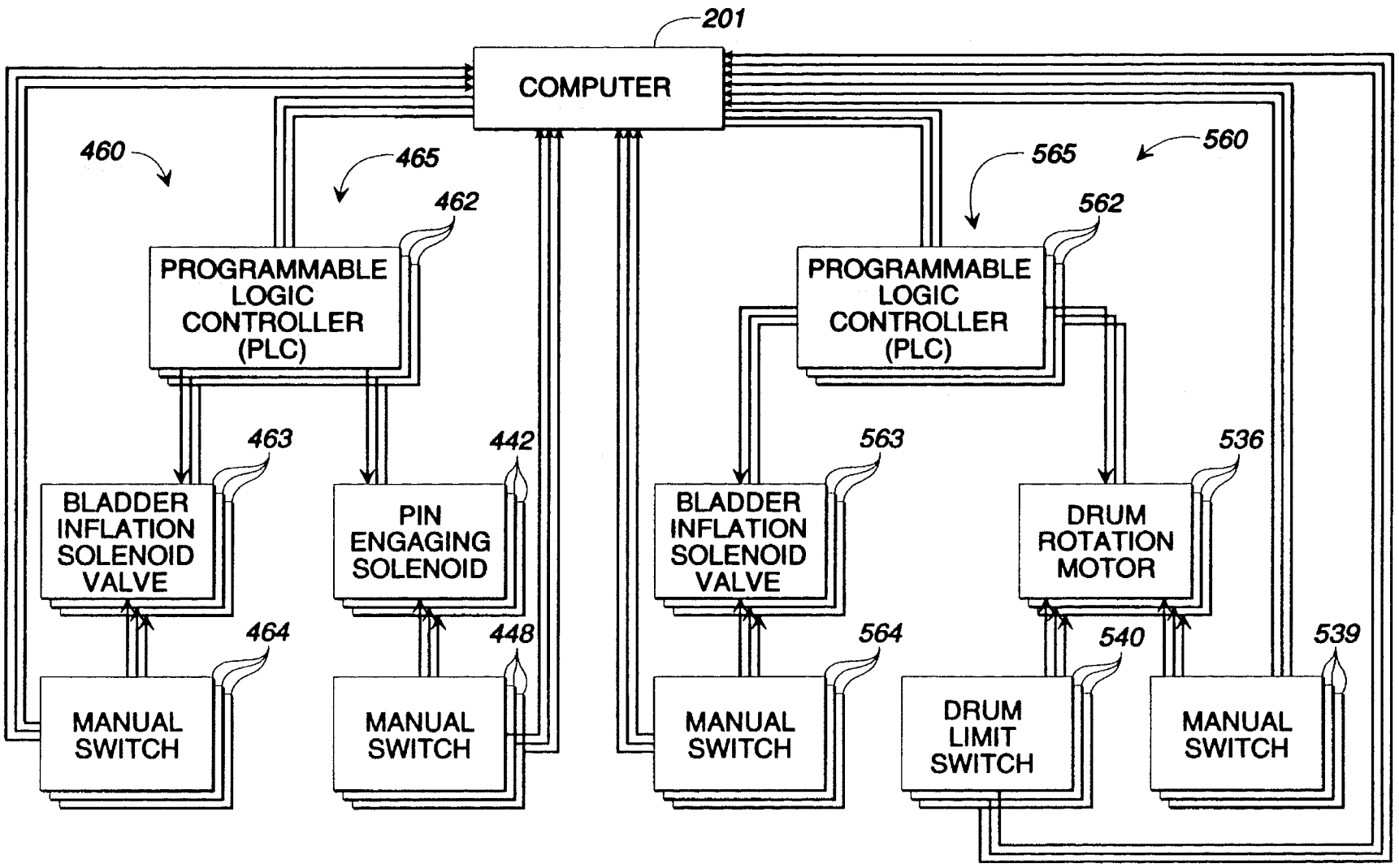
FIG. 2*a* is a block diagram of a control system for controlling the apparatuses of FIGS. 4, 5 and 6.

The support frame and translation assembly 404 further includes a registration assembly 424 which is effective to maintain the support frame 420 and one of the passageways 430*a* and 430*b* in registration with opening 417. The registration assembly 424 includes an electro-mechanical pin engaging solenoid 442 attached to the material chute 414. The solenoid 442 includes an engaging pin 444 adapted to engage one of a pair of registration apertures 445 and 446 disposed in the upper surface 431 of frame 414 at predetermined locations so that the passageways 430*a* or 430*b* of the frame 420 can be selectively, yet fixedly, disposed in registration with the outlet opening 417 of the material chute 414. The pin engaging solenoid 442 may be single acting or double acting. A single acting pin engaging solenoid comprises a pin biased in an extended or a retracted position, usually by a spring. Energizing the solenoid overcomes the spring bias and causes the pin to move opposite the bias position. A double acting pin engaging solenoid is a type of solenoid that requires electrical energization to move the pin from the extended position to the retracted position and vice-versa. The pin engaging solenoid is actuated by a manual switch 448 which is shown in FIG. 2*a* and described below. The registration assembly 424 further includes a bias spring 449. The bias spring 449 causes the frame 420 to translate from position $P_1$ to position $P_2$ when the solenoid pin 444 is disengaged from the aperture 445. The bias spring 449 includes a first spring end 450 which attaches to the material chute assembly 402 by a chute mounted spring support 452, and an opposing spring end 451 attached to the frame 420, adjacent the aperture 446, by a frame mounted spring support 453. The bias spring 449 resides in a relaxed state when the frame 420 is in position $P_2$, that is, when passageway 430*b* is disposed in registration with material passage opening 417. The bias spring 449 is set, or reset, manually in an extended state by pushing the frame 420 to position $P_1$, so that passageway 430*a* is disposed in registration with material passage 417 with the pin 444 locked in the frame aperture 445. Although the spring 449 provides reliable operation, other means are available for causing the frame 420 to translate from position $P_1$ to position $P_2$. A hydraulic cylinder, preferably a double acting hydraulic cylinder, may be used instead of the spring 449. Or, an electric motor 454 mechanically interconnected to the frame 420 through a rack and pinion arrangement 455, shown in phantom lines in FIGS. 4*a* and 4*b*, may be adapted to cause the frame 420 to be translated from $P_1$ to $P_2$. A benefit of using the hydraulic cylinder or an electric motor to translate support frame 420 is that a registration assembly 424 incorporating a hydraulic cylinder or electric motor can be designed to avoid the need to manually set and reset the frame 420, as is necessary when the bias spring 449 is used, the bias spring 449 being incapable of causing the frame 420 to translate from $P_2$, back to $P_1$.

Each container chute assembly 405*a* and 405*b* includes a generally cylindrical chute 114*a* and 114*b*, inflatable bladders 110*a* and 110*b* and elastic closures 108. Each chute 114 comprises an opposed chute open end 116 and defines a material passageway 456 therethrough. Each bladder 110 is disposed circumferentially around and attached to an exterior surface 457 of the chutes 114 near the chute open end 116. A closure 108 is engaged about the containers 104*a* and 104*b*, beneath the bladders 110*a* and 110*b*. Several other elastic closures 108 are shown stored for future use adjacent the frame 420 above the bladders 110.

Referring now to FIG. 2*a*, there is shown a block diagram of a control systems 460 having a plurality of control branches 465 for controlling the operations of a plurality of apparatuses 400 of FIG. 4 in conjunction with a system for sorting packages.

The control system 460 includes a computer 201 which may be the computer 201 used with the control system 200 for operating the loading and closing apparatus 100, or the control system 460 may include its own dedicated computer 201. The plurality of control branches 465 are illustrated diagrammatically by multiple diagram blocks aligned behind and in perspective presentation with, a first diagram block containing that block's written description. Each control branch 465 of the control system 460 includes a programmable logic circuit (PLC) 462, a two-position inflation solenoid valve 463 and a pin engaging solenoid 442, both of which are controlled by the PLC 462. Each control branch 465 further includes an inflation manual switch 464 for manually tripping the bladder inflation solenoid 463, and a pin engaging manual switch 448 for manually tripping the pin engaging solenoid 442. The inflation solenoid valve 463 is electrically connected to the PLC 462 and to manual switch 464. The PLC 462 causes the inflation solenoid valve 463 to open or close in response to an appropriate control signal received from the computer 201 or the manual switch 464 may be manually triggered to cause the solenoid valve 463 to open or close. When the manual switch 464 closes the valve 463, a signal is sent to the computer 201 that the bladder 110 has been inflated thus providing an indication that a container 104 is present about the bladder 110.

The pin engaging solenoid 442 is electrically actuated by the PLC controller 462, in response to a computer signal, or by the manual switch 448. Actuating the manual switch 448 not only actuates the pin engaging solenoid 442 but also sends a status signal to the computer 201 that the solenoid 442 has been actuated thus indicating that the frame 420 is in a fixed position.

Figure 9:
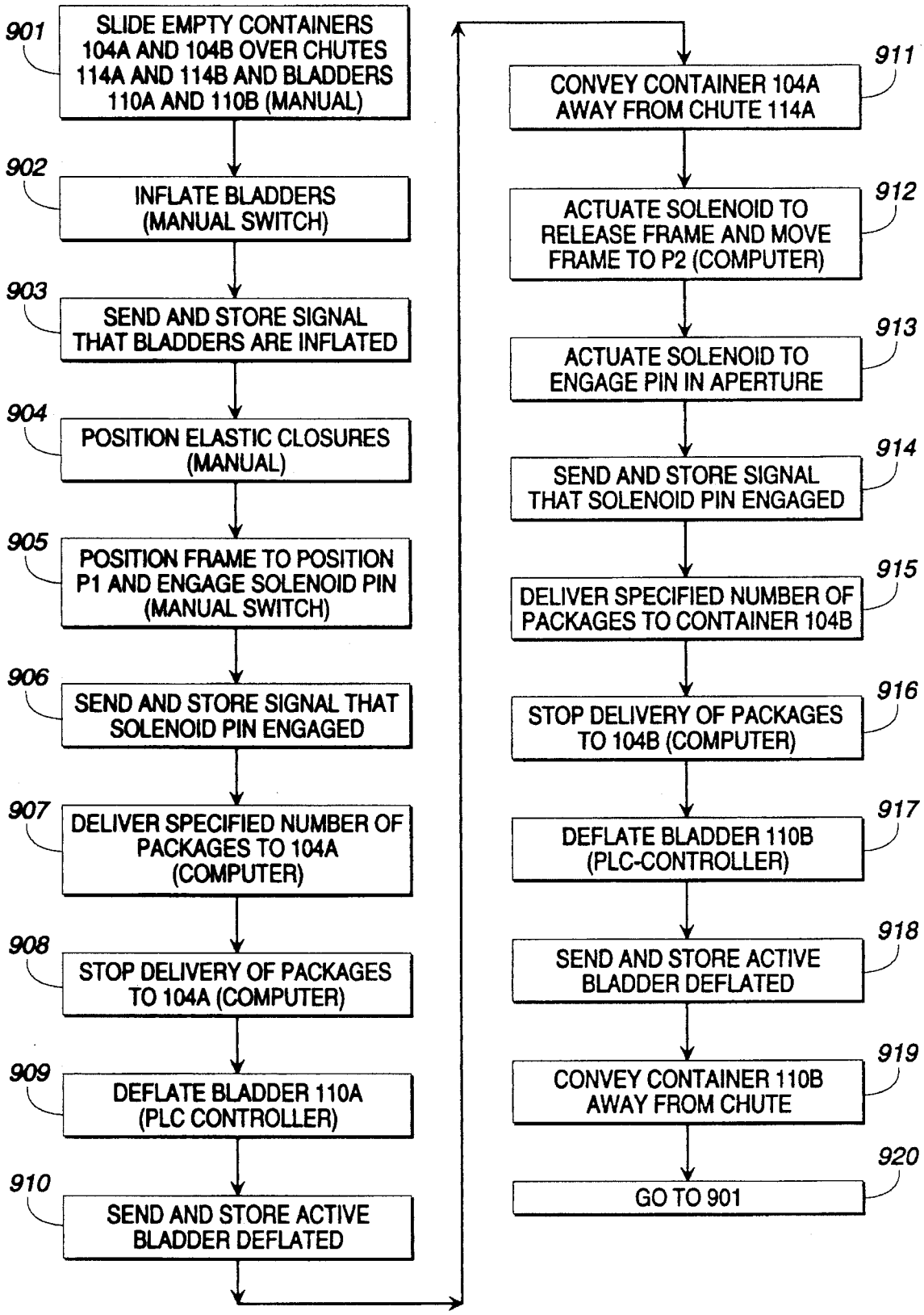
FIG. 9 is a process flow diagram for the apparatus of FIG. 4 and 6.

Referring now to FIG. 9, there is shown a process flow diagram of the operation of the apparatus 400 of FIG. 4, according to a preferred embodiment of the present invention. At step 901 an operator initializes the apparatus 400 by placing an empty container 104*a* over the open end 116 of chute 114*a* with the bladder 110*a* in the deflated position. At step 902, the operator triggers manual switch 464 which actuates solenoid 463 to cause bladder 110*a* to inflate, thus securing the container 104*a* to the chute 114*a*. Triggering the switch 464 causes a message indicating that the bladder 110*a* is inflated, and thus, that a container is supported about the chute 114*a*, to be sent to the computer 201, at step 903, where the message is processed and stored. At step 904 the operator positions an elastic closure 108 about the container open end 105*a* by rolling the elastic closure 108 down from the storage area and over the bladder 110*a*. The above steps 901–904 are repeated so as to position and secure the second container 104*b* about the chute 114*b*.

With empty containers 104 now supported about the chutes 114, the frame 420 is moved to position $P_1$, at step 905, by manually sliding the frame 420 to the position $P_1$ and then engaging the solenoid engaging pin 444 with aperture 445 by triggering manual switch 448. With the frame 420 in position $P_1$ the chute assembly 405*a* and the container 104*a* are in an active state, and the chute assembly 405*b* is in a stand-by state. Triggering manual switch 448 sends a message, at step 906, to the computer 201 that the solenoid pin 444 is engaged. At this point the bladder inflation state and the solenoid pin state in the computer 201 are both high which is a condition necessary for the computer 201 to allow the package delivery system to commence delivering packages 102 to container 104*a*. At step 907 the computer instructs the package delivery system to deliver a specified number (or weight, or volume) of packages to the container 104*a*. At step 908, the computer 201 instructs the package delivery system to stop delivery of packages 102 to container 104*a*. At step 909, the PLC 462, in response to a signal from computer 201, sends a signal to the solenoid 203 to deflate the bladder 110*a*. At step 910 a message is sent to the computer 201, from the PLC 462, that the bladder 110*a* is deflated and thus inactive. At step 911, container 104*a* drops from the chute 114*a* and the elastic closure 108 closes the container 104*a*. The container 104*a* drops onto conveyor 112 which conveys the now filled container 104*a* away from the loading area.

At step 912 the computer 201 actuates the pin engaging solenoid 442, to disengage solenoid pin 444 from aperture 445 which allows the frame 420 to translate from position $P_1$ to position $P_2$ under the influence of the bias spring 449. At step 913 the computer 201 actuates the pin engaging solenoid 442 to cause the solenoid pin 444 to engage aperture 446, thereby securing the frame 420 in position P2. At position P2, the chute assembly 405*b*, and the container 104*b*, are in an active state and chute 405*a* is in an inactive state because the bladder 110*a* is not inflated. At step 914 a signal is sent to the computer 201 to indicate that the pin 444 is engaged. At this point the bladder 110*b* inflation state and the pin engaging solenoid state are both high which is a condition necessary for the computer 201 to allow the package delivery system to commence delivering packages 102 to container 104*b*, now positioned under the material chute 414 and poised to receive packages 102. At step 915 the computer 201 instructs the package delivery system to deliver a specified number (or weight, or volume) of packages to the container 104*b*. At step 916, the computer 201 instructs the package delivery system to stop delivery of packages 102 to container 104*b*. At step 917, the PLC 462 sends a signal to the solenoid 463 to deflate the bladder 110*b*. At step 918, a message is sent to the computer 201 that the bladder 110*b* is deflated, and thus inactive. At step 919, container 104*b* drops from the chute 114*b* and the elastic closure 108 closes the container 104*b*. The container 104*b* drops onto conveyor 112 and is taken away from the loading area. At step 920 the operation of apparatus 400 is repeated, as described above, by going to step 901. It is understood that there are alternative modes of operation of apparatus 400 which fall within the scope of the present invention. For example, an operator may choose to replace the container 104*a* on the chute 114*a* intermediate the steps 914–920 while the other container 104*b* is filling. Then following step 919, after container 104*b* is being conveyed away, the operator immediately triggers the manual switch 448 to actuate the pin solenoid 442 to disengage the pin 444 from aperture 446, pushes the frame 420 back to position P1, and then triggers manual switch 448 to actuate the pin solenoid 442 to engage the pin 444 with aperture 445. Then the computer 201 sends a message to begin filling the replacement container 104*a*. While the replacement container 104*a* is filling, the operator may choose to place a replacement container 104*b* on chute 114*b* so that it is ready to receive packages 102 after container 104*a* has been filled.

Figure 5:
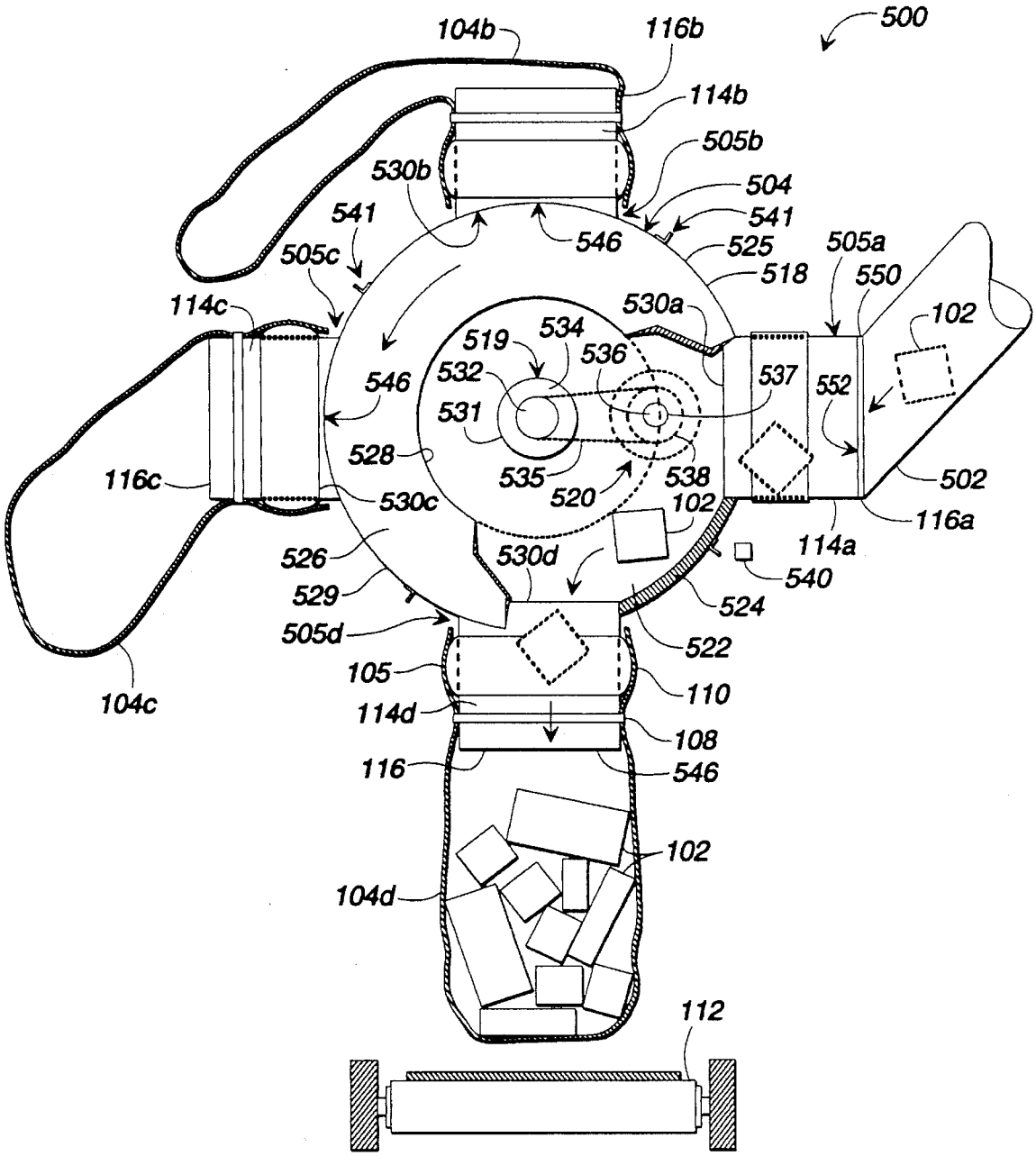
FIG. 5 is a side view shown in partial cross-section of a second alternative embodiment of an apparatus according to the present invention having a plurality of chutes adapted to a rotatable drum for positioning a chute to receive material from a material source and to position another chute to receive the material into a supported container.

In FIG. 5 there is shown a rotatable material loading and closing apparatus 500 for loading material 102 delivered from a material source through a material chute 502.

The apparatus 500 includes a support drum and rotation assembly 504, a plurality of container support chute assemblies 505*a*, 505*b*, 505*c* and 505*d* attached to and extending radially outwardly from the support drum and rotation assembly 504 and spaced equally thereabout. A plurality of material containers 104*b*, 104*c* and 104*d* are shown attached to and supported by the container support chute assemblies 505*b*, 505*c* and 505*d*. The apparatus 500 further includes a conveyor 112, which is disposed beneath the apparatus 500 in fixed relation to the material chute 502.

The support drum and rotation assembly 504 includes a drum 518, supported for rotation by a rotating hub assembly 519 which is rotated by a motor assembly 520. The drum 518 comprises a circular drum back plate 522 mounted to the hub assembly 519. The drum 518 further includes an arcuate sidewall 524 upstanding from the back plate 522 and attached thereto, along a backplate perimeter edge 525. A donut shaped front plate 526, defining an access opening 528 therethrough, is attached to the sidewall 524 along a front plate perimeter edge 529 opposite the backplate perimeter edge 525. The drum sidewall 524 defines a plurality of spaced-apart passageways 530*a*, 530*b*, 530*c* and 530*d* opening into the interior of the drum 518.

The hub assembly 519 includes a hub flange 531 attached to the center of the backplate 522 by bolts or other conventional means. The hub flange 531 is adapted to receive a hub shaft 532. The drum 518 rotates about the longitudinal axis of hub shaft 532. The hub assembly 519 also includes a hub pulley 534 mechanically interconnected to the motor assembly 520 through a pulley belt 535.

Each container chute assembly 505*a*, 505*b*, 505*c* and 505*d* includes a cylindrical chute 114, an inflatable bladder 110 and an elastic closure 108. Each chute 114 comprises a chute open end 116 and defines a material passageway 546, therethrough. The chutes 114 attach to the drum 518 through the passageways 530 and project radially outward from the sidewall 524. The bladder 110 is disposed circumferentially around and attached to the exterior surface of each chute 114 near the chute open end 116. Closures 108 are engaged about the containers 104*b*, 104*c* and 104*d* at a position adjacent the bladder 110 and opposite the drum 518 relative to the bladder 110.

The material chute 502 includes an angled outlet end 550 defining an outlet opening 552. The material chute 502 feeds material 102 from a material source into the chute 114*a* that functions in the position shown in FIG. 5 as a material chute extension that opens into the interior of the drum 518. The arcuate surface of the sidewall 524 directs the material 102 toward the chute 114*d*.

The motor assembly 520 includes a motor 536 having a motor shaft 537 which mounts a motor shaft pulley 538. The motor 536 mechanically interconnects with the hub pulley 534 through the pulley belt 535 so as to cause the drum 518 to rotate in response to motor 536 rotation. A manual switch 539 shown in FIG. 2*a*, for manually controlling the drum 518 rotation, and a limit switch 540, actuated by drum mounted trippers 541, are electrically connected to the motor 536 and computer 201. The limit switch 540 is supported in any convenient manner adjacent to the drum in the path of the tripper 541.

Referring again to FIG. 2*a*, there is shown a block diagram of a control system 560, having a plurality of control branches 565, for controlling the operations of a plurality of apparatuses 500 of FIG. 5 in conjunction with a system for sorting packages. The control system 560 includes a computer 201 which may be the computer 201 used with the control systems 200 and 460 for operating the loading and closing apparatus 100 and 400, respectively, or the control system 560 may include its own dedicated computer. For clarity, the plurality of control branches 565 are illustrated diagrammatically by multiple diagram blocks aligned behind, and in perspective presentation with, a first diagram block containing that block's written description. Each control branch 565 of the control system 560 includes a programmable logic circuit (PLC) 562, a two-position inflation solenoid valve 563 and a drum rotation motor 536, both of which are controlled by the PLC 562. Each control branch 565 also includes a bladder inflation manual switch 564, a drum rotation manual switch 539 and a drum rotation limit switch 540.

The inflation solenoid valve 563 is electrically connected to the PLC 562 and to the manual switch 564. The PLC 562 causes the solenoid valve 563 to open in response to an appropriate control signal received from the computer 201. The manual switch 564 may be manually triggered to cause the inflation solenoid valve 563 to close. When the manual switch 564 closes the valve 563, a signal is sent to the computer 201 that the bladder 110 has been inflated thus providing an indication that a container 104 is present about the bladder 110.

The drum rotation motor 536 is electrically connected to the PLC 562 and to the manual switch 539 and limit switch 540. The PLC 562 causes the drum rotation motor 536 to operate in response to an appropriate control signal received from the computer 201, to cause the drum 518 to be rotated in a prescribed direction, and through a defined angular displacement, the angular displacement being ninety degrees for the configuration of the apparatus 500 shown in FIG. 5. The manual switch 539 may be manually triggered to cause the drum 518 to rotate when desired by an operator, during container placement, for example. When the manual switch 539 is triggered a signal is sent to the computer 201 indicating that the drum 518 is rotating. As the drum 518 approaches the ninety degree angular displacement the limit switch 540 engages a tripper 541 and trips the limit switch 540. The tripper 541 is positioned so that when the drum rotation motor 536 and the drum 518 stop rotating, a chute 114, acting as a material chute extension, is aligned with the material chute 502. When the limit switch 540 is tripped a message is sent to the computer 201 telling the computer 201 that the drum 518 has ceased rotation. Since damage would likely occur to a container 104 supported on a chute assembly 505 that is moved into registration with the material chute 502, motor rotation is further proscribed by the computer 201 which monitors the inflation solenoid valve 563 to indicate the inflation status of the bladder 110 of the downwardly oriented chute assembly 505. Therefore, if the bladder 110 of the downwardly oriented chute assembly 505 is sensed by the computer 201 as being inflated, which is interpreted as a container 104 being present about the chute 114, the computer 201 will not allow the drum 518 to be rotated to the next position.

Figure 10:
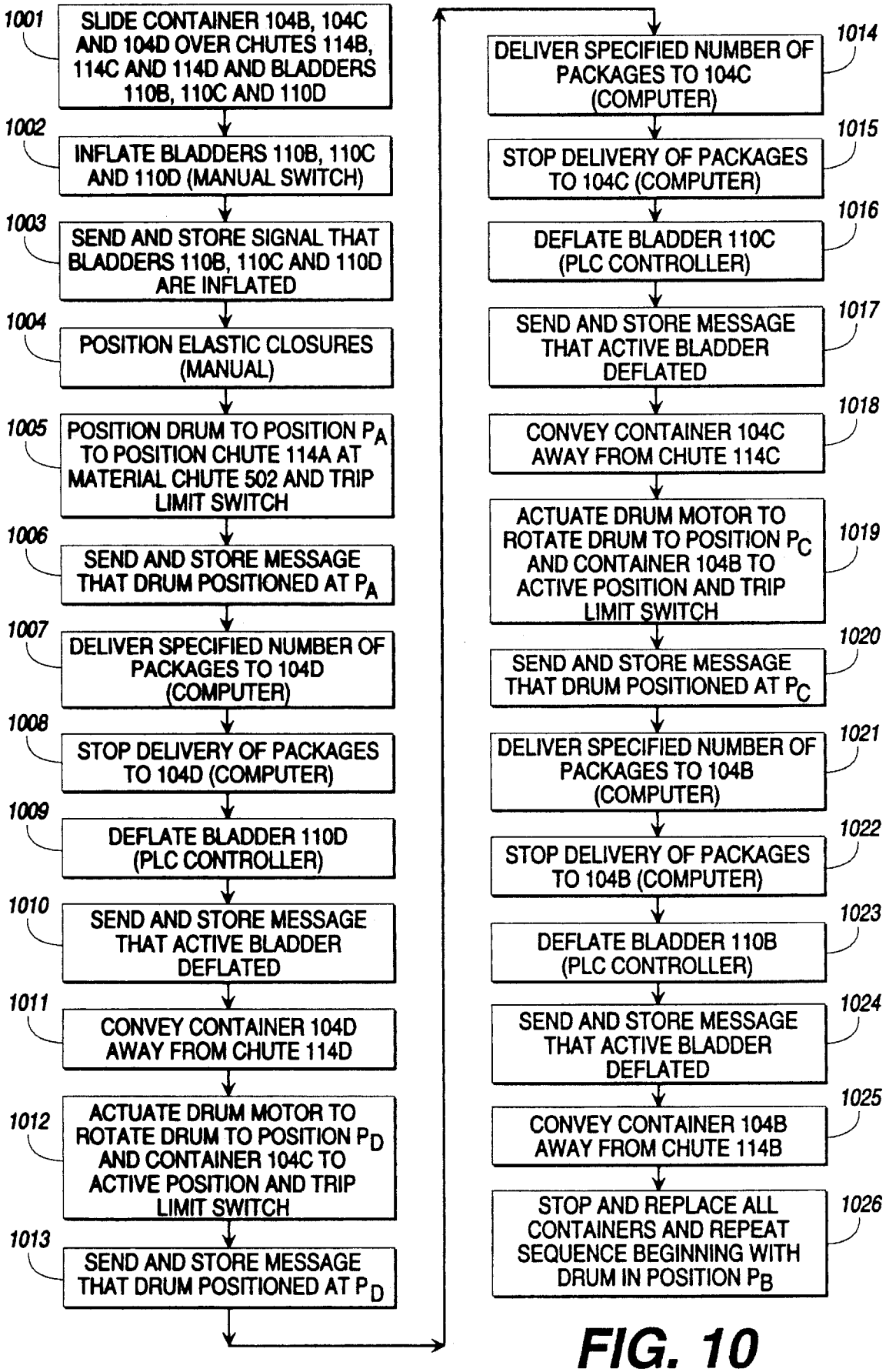
FIG. 10 is a process flow diagram for the apparatus of FIG. 5.

The operation of the loading and closing apparatus 500 is shown in a process flow diagram of FIG. 10 and described below. The following description of the operation of the apparatus 500 assumes an operating mode whereby the apparatus is set up in an initial configuration by fitting three containers 104 to three available chute assemblies 505. The fourth chute assembly 505 is disposed adjacent the material chute 502, thereby acting as a material chute extension, and thus cannot be fitted with a container 104 at the initial position of the apparatus 500. The apparatus 500 is then operated through a complete cycle, during which the three containers 104 present during the initial set-up are filled. The apparatus 500 is then refitted with three replacement containers and the operation continues. Other operating modes of the apparatus 500 are possible.

The operation of apparatus 500 proceeds as follows: At step 1001 an operator places an empty container 104*b* over the open end 116*b* of chute 114*b* and the bladder 110*b* in the deflated position. At step 1002, the operator triggers manual switch 564 which actuates solenoid 563 to cause bladder 110*b* to inflate, thus securing the container 104*b* to the chute 114*b*. At step 1003, in response to triggering switch 564, a message indicating that the bladder 110*b* is inflated, and thus, that a container is supported about the chute 114*b*, is sent to the computer 201, where the message is processed and stored. At step 1004 the operator positions an elastic closure 108 about the container open end 105*b* by rolling the elastic closure 108 down from the storage area and over the bladder 110*b*. The drum 518 is then rotated so that chute 114*c* can be fitted with a container 104*c*. The drum is rotated by triggering manual switch 539 (see FIG. 2*a*) which causes the motor 536 to turn a prescribed angular distance as described above. The steps 1001–1004 are repeated with respect to the installation of containers 104*c* and 104*d* about chutes 114*c* and 114*d*. At step 1005 the drum is rotated to position $P_A$ to place the drum in an initial position with chute 114*a* disposed to receive packages 102 from the material chute 502 and container 104*d* in a downward orientation to receive the packages 102. At step 1006 a signal is sent to and stored by the computer 201 indicating that the drum 518 is set at an initial position, $P_A$. The signal of step 1006 is generated by the manual switch 548 or may be generated by the drum rotation limit switch 540.

With the drum 518 in position $P_A$, the chute assembly 505*d* and the container 104*d* are in an active state, and the chute assemblies 505*c* and 505*b* are in a stand-by state. At this point the bladder inflation state and the position limit switch state in the computer 201 are both high for the chute assembly 505*d* which is a condition necessary for the computer 201 to allow the package delivery system to commence delivering packages 102 to container 104*d*. At step 1007 the computer instructs the package delivery system to deliver a specified number (or weight, or volume) of packages to the container 104*d*. At step 1008, the computer 201 instructs the package delivery system to stop delivery of packages 102 to container 104*d*. At step 1009, the PLC 202, in response to a signal from computer 201, sends a signal to the solenoid 563 to deflate the bladder 110*d*. At step 1010 a message is sent to the computer 201, from the PLC 202, that the bladder 110*d* is deflated and thus inactive. At step 1011, container 104*d* drops from the chute 114*d* and the elastic closure 108 closes the container 104*d*. The container 104*d* drops onto conveyor 112 which conveys the now filled container 104*d* away from the loading area.

At step 1012 the computer sends a signal to the PLC 562 which triggers the motor 536 to cause the drum 518 to rotate to the next position, $P_D$, and to position chute 114*c*, with supported container 114*c*, to receive packages 102 that are introduced into the drum 518 through chute 114*d*. At step 1013 a message, generated by the limit switch 540 as it is tripped by a tripper 541, causes the motor 536 to stop rotating, and is sent to and stored by the computer indicating that the drum 518 is in the next position. The computer detects that the drum 518 is in position $P_D$ by counting the number of times the limit switch 540 has tripped from the initial position, $P_A$. At this point the computer state for bladder 110*c* inflation and the limit switch state are both high which is a condition necessary for the computer 201 to allow the package delivery system to commence delivering packages 102 to container 104*c*, now positioned to receive packages 102. Thus, at position $P_D$, the chute 114*c* supports container 104*c* in an active state, chute 114*b* and container 104*b* are in a stand-by state and chute 114*a* is in an inactive state because the bladder 110*a* is deflated, indicating that no container is supported on chute 114*a*. At step 1014 the computer 201 instructs the package delivery system to deliver a specified number (or weight, or volume) of packages 102 to the container 104*c*. At step 1015, the computer 201 instructs the package delivery system to stop delivery of packages 102 to container 104*c*. At step 1016, the PLC 202 sends a signal to the solenoid 563 to deflate the bladder 110*c*. At step 1017, a message is sent to the computer 201 that the bladder 110*c* is deflated, and thus inactive. At step 1018, container 104*c* drops from the chute 114c and the elastic closure 108 closes the container 104*c*. The container 104*c* drops onto conveyor 112 and is taken away from the loading area.

At step 1019 the computer 201 sends a signal to the PLC which triggers the motor 536 to cause the drum 518 to rotate to the next position, $P_C$, and to position chute 114*b*, with supported container 114*b*, to receive packages 102 that are introduced into the drum 518 through chute 114*c*. At step 1020 a message, generated by the limit switch 540 as it contacts a tripper 541 is sent to and stored by the computer indicating that the drum 518 is in the next position, which the computer determines as being position $P_C$. At this point the computer status for bladder 110*b* inflation and the limit switch states are both high which is a condition necessary for the computer 201 to allow the package delivery system to commence delivering packages 102 to container 104*b*, now positioned to receive packages 102. Thus, at position $P_C$, the chute assembly 505*b* supports container 104*b* in an active state and chutes 505*d* and 505*a* are each in an inactive state because the bladders 110*d* and 110*a* are deflated, indicating that no containers 104 are supported on chutes 114*d* and 114*a*. At step 1021 the computer 201 instructs the package delivery system to deliver a specified number (or weight, or volume) of packages to the container 104*b*. At step 1022, the computer 201 instructs the package delivery system to stop delivery of packages 102 to container 104*b*. At step 1023, the PLC 202 sends a signal to the solenoid 563 to deflate bladder 110*b*. At step 1024, a message is sent to the computer 201 that the bladder 110*b* is deflated, and thus inactive. At step 1025, container 104*b* drops from the chute 114*b* and the elastic closure 108 closes the container 104*b*. The container 104*b* drops onto conveyor 112 and is taken away from the loading area.

At this point, all of the containers 104 fitted initially to the chutes 114, have been filled with packages and have been dropped from their respective chute assemblies 505 and then have been transported away on the conveyor 112. Because no active or stand-by chute assemblies 505 remain, the apparatus is unable to continue and must be refitted with containers 104 as described above. In step 1026, the process described above is repeated.

As stated above, the apparatus 500 is capable of being operated according to other modes of operation contemplated within the scope of the invention. For example, an operator could replace containers 104 on chutes 114 at points during the operational sequence of apparatus 500 and not wait until the apparatus 500 has advanced through all steps 1001–1026. For example, in the configuration shown in FIG. 5, a container 104*a* could be applied to chute 114*a* just after the drum 518 has been rotated in step 1012, if chute 114*a* (extending vertically upward) is made accessible for the purpose of installing a container 104*a* over the chute open end 116*a*. Or, a container 104 can be installed after the next rotation, when the chute 114*a* extends horizontally.

Figure 6:
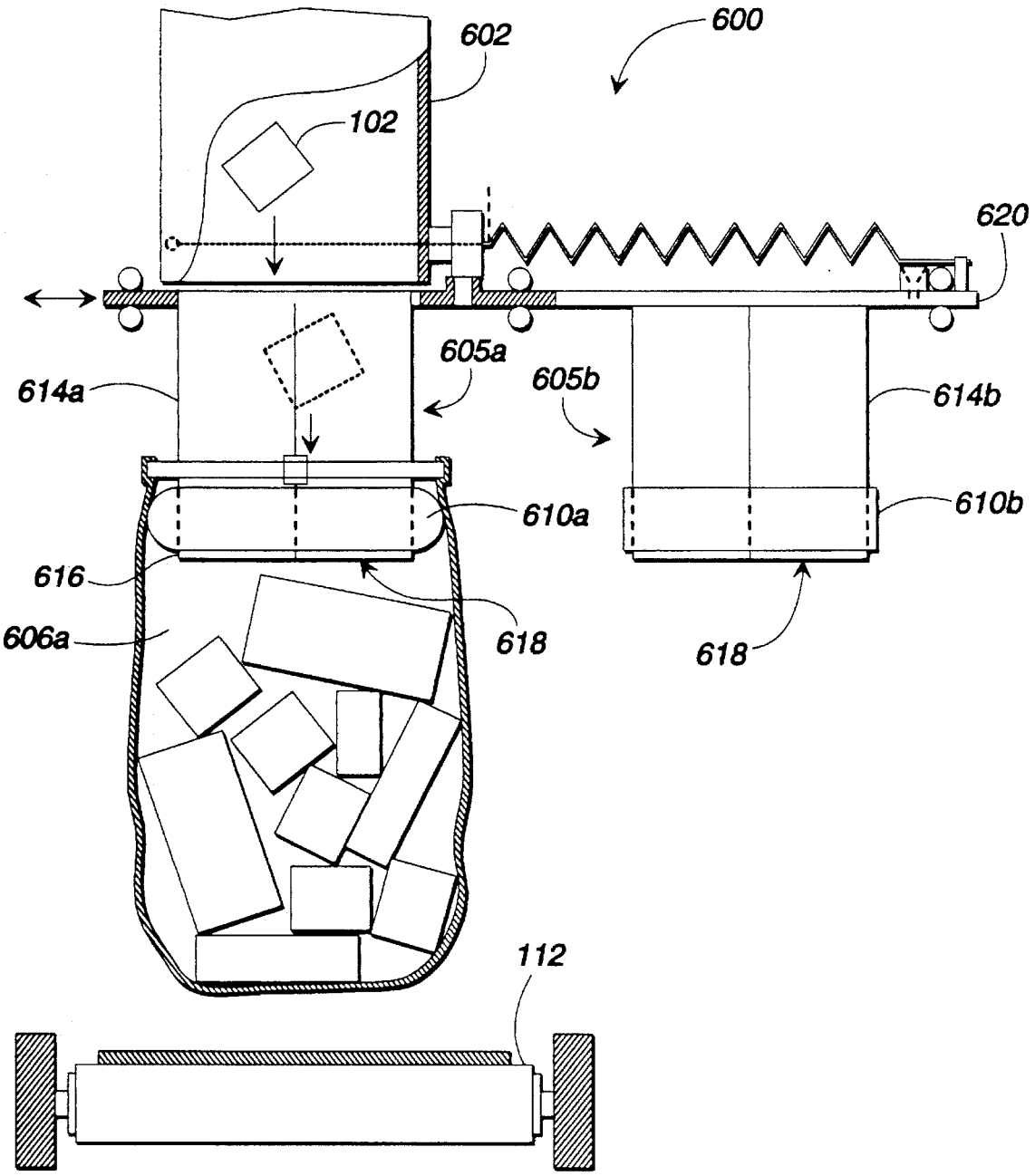
FIG. 6 is a side view shown in partial cross-section of a second configuration of the first alternative embodiment of the apparatus shown in FIG. 4 which includes a plurality of chutes having a rectangular transverse cross-section supported by a translatable frame.

An alternative translatable material loading and closing apparatus 600, similar to the translatable loading apparatus 400, is shown in FIG. 6. The material loading and closing apparatus 600 is adapted to load material 102 delivered from a material source through an overhead material chute assembly 602. The apparatus 600 differs from apparatus 400 only in the configuration of the chute assemblies adapted to the translating frame and the type of container and closure adaptable to the chute assembly. Therefore, only the chute assemblies and containers adaptable thereto are described hereinbelow.

The apparatus 600 includes container chute assemblies 605*a* and 605*b*, adapted to a translating frame 620, and a spring closure material container 606*a* attached to and supported by the container chute assembly 605*a*. A conveyor 112 is disposed beneath the apparatus 600 in fixed relation to the material chute 602.

Each container chute assembly 605*a* and 605*b*, includes a rectangular, preferably square, chute 614 and an inflatable bladder 610. Each chute 614 comprises a container engaging end 616 and defines a material passageway 618 therethrough. Chute assembly 605*b* is shown without a material container 606*b* and with its bladder deflated so as to enhance the clarity of features described below and to show the bladder 610*b* in a deflated state.

The bladders 610 are air-tight sleeves adapted to fit over a square shaped structure. The bladders 610 are disposed about the chutes 614 and attached to the chute exterior surface at the container engaging end 616. The protuberance of the deflated bladder 610*b* from the chute 614, is very slight; The slight protuberance from the chute 614*b* is sufficient to allow an empty container 606 to be positioned easily over the bladder 610*b*, as well as to allow a filled container 606 to fall reliably from the chute 614*b* over the deflated bladder 610*b*. When the bladder 610 is inflated, the exterior wall of the bladder 610 is sufficiently protuberant so that it engages the inside portions of the container 606 and supports the container 606 while the container 606 is loaded.

The spring closure containers 606, used with the apparatus 600, are shown in greater detail in FIG. 7*a*, 7*b*, 8*a* and 8*b*. The container 606 includes a container sidewall portion 660 having a closed end 662 and a flexible open end 664 defining a container opening 665. The container 606 further includes a spring closure assembly 668, shown in FIGS. 8*a* and 8*b*, attached to the sidewall 660 adjacent the container open end 664 by overlapping a portion of the sidewall 660 adjacent the container opening 665 and stitching the overlapped sidewall portion to the sidewall 660 to secure the closure assembly 668 within the hem. The spring closure assembly 668 includes opposed wire springs 670 joined together hingedly by integral hinges 671. Each wire spring 670 comprises a single length of wire formed to provide a coil spring 674 and first and second wire spring arms 676*a* and 676*b* extending from the coil spring 674 and substantially parallel to one another when the spring 670 is in a relaxed state.

Figure 8A:
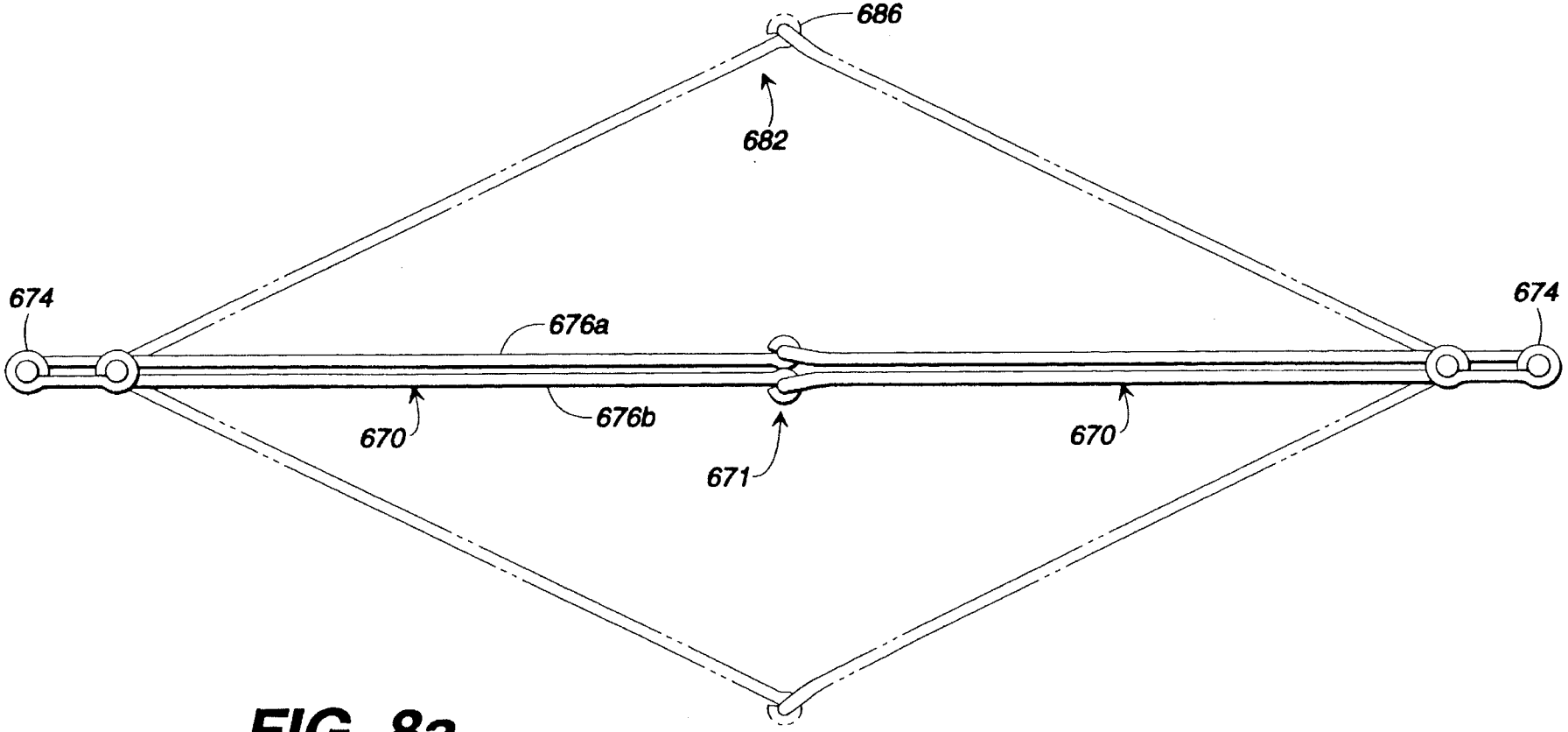
FIG. 8*a* is a top elevational view of a spring closure assembly with the spring closure shown in phantom lines in a partially open position.
Figure 8B:
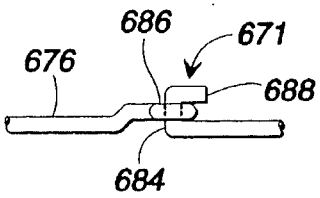
FIG. 8*b* is a fragmentary side elevational view of the hinge assembly of the spring closure shown in FIG. 8*a;*

As shown in detail in FIG. 8*b*, each spring arm 676*a* and 676*b* includes either a turned down hinge pin 684 or a hinge loop 686 at a distal end 682 of the arm 676 opposite the coil spring 674. The hinge loop 686 of the spring arm of one of the wire springs is hingedly engaged with a hinge pin 684 of the opposed wire spring 670 of a spring closure assembly 668. This configuration may be accomplished by providing a wire spring 670 having only hinge pins 684 and the opposed wire spring 670 having only hinge loops 686, or each wire spring 670 is provided with one hinge loop 686 and one hinge pin 684. The opposed wire springs 670 are then assembled to form a spring closure assembly 668 by disposing the hinge pins 684 of one wire spring 670 with the hinge loops 686 of the other wire springs 670. The hinge pin 684 is retained in the hinge loop 686 by providing a second bend 688 in the pin approximately perpendicular to the hinge pin 684 relative to the spring arm 676 so as to interlock the hinge pin 684 with the hinge loop 686. Alternatively the end of the hinge pin 684 may be peened to prevent it from withdrawing from the hinge loop 686.

Figure 7A:
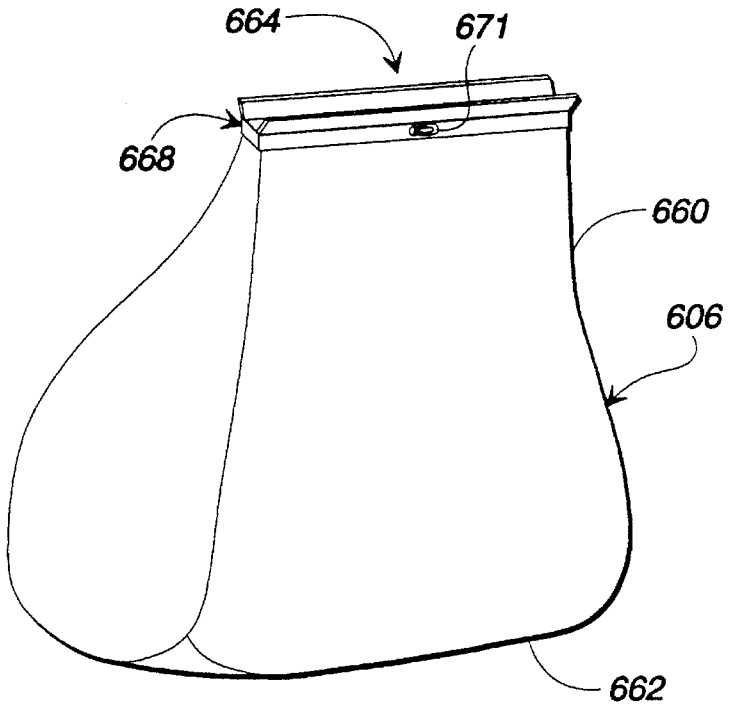
FIG. 7*a* is a perspective view of a container with a spring closure device adapted to the container open end, disposed in a closed state.
Figure 7B:
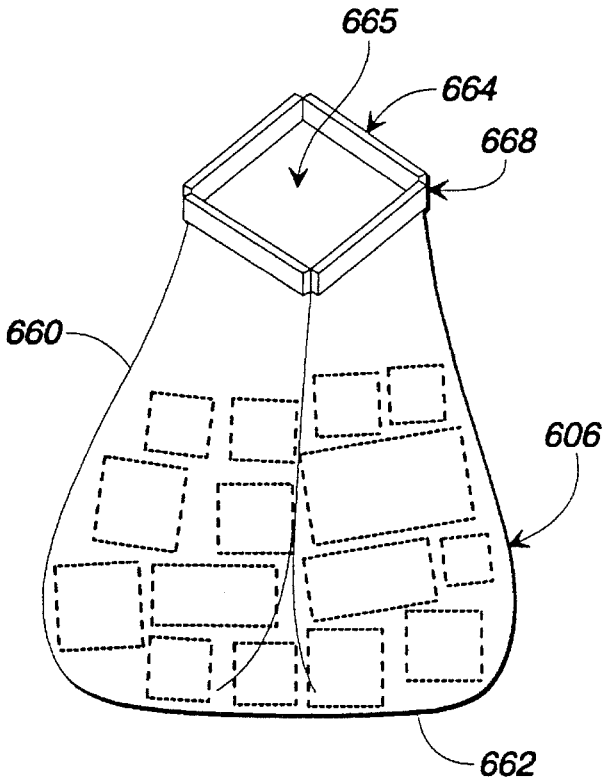
FIG. 7*b* is a perspective view of the container shown in FIG. 7*a* with the open end disposed in an open state.

As shown in FIGS. 7*b* and 8*a*, the configuration of the spring closure assembly 668 causes the container open end 664 to form, when opened, into a square container opening 665. It should be understood that open end configurations, other than square, are capable with the spring closure assembly 668. For example, a rectangular container opening having unequal adjacent sides may be provided by incorporating in the container 606 a spring closure assembly 668 comprising a pair of wire springs 670, each wire spring 670 having adjacent spring arms 676*a* and 676*b* of unequal length. The shorter length spring arm 676 of one of the wire springs 670 is mechanically engaged with the longer length spring arm 676 of the other wire spring 670 through an integral hinge 671. Thus, when the spring assembly 668 is in a relaxed or closed position the spring arms 676*a* and 676*b* of the wire springs 670 are substantially parallel. As the alternative spring assembly 668 is opened it assumes a rectangular, but non-square, configuration since the opposed springs arms 676 are equal in length and the adjacent spring arms 676 are unequal in length.

An empty container 606 is fit over the rectangular chute open end 616 by first forcing the container open end 664 open by pushing the coil springs 674 towards each other. Then, with the bladder 610*b* in a deflated state (shown in FIG. 6), the container open end 664 is positioned about the chute open end 616 such that the open end 664 resides above the bladder 610*b*. The force of the spring assembly 668 against the chute 614*b* is sufficient to prevent the container 606 from falling from the chute 614*b* while the container 606 remains empty.

The bladder 610*b* is then inflated by actuating the bladder solenoid valve 203 by manual switch 204 (see FIG. 2). The inflated bladder, 610*a* in FIG. 6, provides support sufficient to support the container 606 when fully loaded with material 102. When the container 606 is fully loaded with material 102, the loaded container 606 is allowed to drop to the conveyor 112 by deflating the bladder 610. The configuration of the bladder 610 in a deflated state allows the container open end 664 to slide over the bladder 610 without interference between the container open end 664 and the projection of the deflated bladder 610 from the chute 614. As the container 606 disengages the chute 614 the container open end 664 is urged closed by the spring closure assembly 668 sufficient to retain the material 102 within the container 606.

As used herein, a container is considered "closed" when the container open end, 105 or 664, depending on the container considered, is at least partially closed under the force of a closure device, 108 or 668, sufficient to prevent material 102 residing in the container 606 from spilling from the container 104 or 606 even if the container is tipped. To enhance the closure of the open end 664 of the container 606, hook and loop fasteners, commonly referred to as "VELCRO"® (a product of Velcro Systems, Inc.) may be applied to the inside surfaces of the container 606 adjacent the open end 616 with the hook part opposite the loop part when the container end is open. The hook part automatically engages the loop part when the spring arms 676*a* and 676*b* are brought together fully.

The structure of the containers 606 makes them adaptable to be supported on the chute open end 616 by mechanical retainers that do not employ inflatable bladders. For example, mechanical hooks (not shown) secured to the chute 614 and engagable with portions of the spring closure assembly 668 are useful for securing the containers 606 about the chute open ends 616. Such hooks could be retractable by solenoid actuators when the container is ready to drop. Thus, where mechanical retainers are used for supporting containers 606 on the chutes 614, the bladder inflation solenoid 203 may be replaced with a retainer actuating solenoid controlled by the manual switch 204.

The operation of the loading and closing apparatus 600 is substantially similar to the operation of the translating apparatus 400. Furthermore, it should be understood that the alternate chute assemblies 605 and spring closure assemblies 668 may be used in the drum apparatus 500 shown in FIG. 5, and that containers 606, with spring closure assemblies 668, may be used with circular chute assemblies shown in FIGS. 1, 4 and 5, provided that the container opening 665 has dimensions large enough to fit over the bladder 110 in a deflated state, but small enough to ensure engagement with the bladder 110 in an inflated state sufficient to support the container 606 filled with material 102.

The present invention may be embodied in other specific forms without departing from the spirit or essential attributes of the invention. For example, it will be understood by those skilled in the art that the present invention may be used to load material other than packages into flexible containers. For example, apparatus 100 may be used to load loose particulate matter, liquids, and other objects or materials.

It will be further understood that various other changes in the details, materials, and arrangements of the parts which have been described and illustrated in order to explain the nature of this invention may be made by those skilled in the art without departing from the principle and scope of the invention is expressed in the following claims.

What is claimed is:

1. An apparatus for loading and closing a container having a flexible open end, comprising:

a container having a flexible open end;

a movable chute assembly comprising a support frame and at least two chutes supported by said support frame, each chute having a chute open end adapted to receive the flexible open end of the container thereabout and being movable to alternately position each of said chutes to receive a material from a material source;

a selectively inflatable bladder disposed around the chute open end of each of said chutes and adapted (a) to engage the flexible open end of the container when inflated to secure the open end of the container to the chute open end of the respective chute and (b) to disengage the flexible end of the container when deflated to release the container from the chute open end of the respective chute; and a closure engaged about the open end of the container, wherein said closure automatically closes the open end of the container in response to the container disengaging from the chute open end.

2. The apparatus of claim 1 wherein said movable chute assembly is movable from a first position to at least a second position so that one of said chutes is disposed in registration with the source of material to receive material through said chute while in said first position, and another of said chutes is disposed in registration with the source of material to receive material through another chute while in said second position.

3. The apparatus of claim 2 further including: moving means for moving said moveable chute assembly from said first position to said at least a second position.

4. The apparatus of claim 3 wherein said moveable chute assembly is a linearly translatable assembly and said moving means comprises:

a linear translation mechanism including:

a support assembly for supporting said chute assembly during linear translation, a spring, and a linkage assembly operatively interconnecting the spring to said chute assembly for causing said chute assembly to linearly translate selectively from said first position to said at least a second position.

5. The apparatus of claim 3 wherein said moveable chute assembly is a translatable assembly and said moving means comprises:

a translation mechanism including:

a support assembly for supporting said chute assembly during translation, a motor, and a linkage assembly operatively interconnecting the motor to said chute assembly for causing said chute assembly to translate selectively from said first position to said at least a second position.

6. The apparatus of claim 5 wherein the motor comprises an electric motor.

7. The apparatus of claim 3 wherein said moveable chute assembly is a rotatable assembly and said moving means comprises:

a support assembly for rotatingly supporting said chute assembly, a motor, and a linkage assembly operatively interconnecting the motor means to said chute assembly for causing said chute assembly to rotate selectively from said first position to said at least a second position.

8. The apparatus of claim 7 wherein the motor comprises an electric motor.

9. The apparatus of claim 2 wherein:

the container comprises a flexible container body comprising a body sidewall and having a closed end and an open end defining a container opening, and the closure comprises a spring closure device engaged about the body sidewall adjacent the open end of the container body for urging the container open end into a closed position, said spring closure comprising first and second spring assemblies, said first spring assembly hingedly engaged with said second spring assembly, each spring assembly including first and second spring arms interconnected through an integral spring portion, the first and second spring arms being disposed in substantially parallel relation when said container is closed and capable of being angularly displaced when the container open end is urged into an open state, such that when the container is urged into an open state the container open end opening is substantially rectangular in shape.

10. An apparatus for loading and closing a container having a flexible open end, comprising:

a container having a flexible open end;

a chute having an open end;

an inflatable bladder disposed around the open end of the chute end engagable with the open end of the container to support the container about the chute open end; and a closure device engaged around the open end of the container, wherein the closure device automatically closes the open end of the container in response to the container sliding off the open end of the chute.

11. An apparatus for loading and closing a container having a flexible open end, comprising:

a container having a flexible open end;

a chute having an open end;

a container retainer engaged with the open end of the container and adapted to support the open end of the container about the chute open end; and a closure device engaged with said container open end, wherein the closure device automatically closes the open end of the container in response to the container sliding off the open end of the chute.

12. The apparatus of claim 11 wherein the container retainer is adapted to support the container open end about the chute open end at least until a predetermined quantity of material is caused to be disposed in the container, and wherein the closure device is a spring closure device which automatically closes the open end of the container in response to the container sliding off the open end of the chute.

13. The apparatus of claim 12 wherein said open end of said chute comprises a rectangular transverse cross-section shape; and, wherein said spring closure device comprises a plurality of leg assemblies comprising elongate legs pivotally engaged with one another, end-to-end, and including at least one closure spring engaged with at least two of the legs so as to urge the plurality of legs into parallel alignment with one another so as to close the container opening.

14. The apparatus of claim 13 further including an inflatable bladder disposed about said chute adjacent said open end, said bladder being inflatable to support said container about said chute while material is loaded into said container, and said bladder being deflatable to allow said container to slide off of said chute.

15. A method for loading and closing containers each having a flexible open end, comprising the steps of:

providing a movable chute assembly comprising a support frame and at least two chutes supported by said support frame, each chute having a chute open end and an inflatable bladder disposed thereabout, each chute open end and an inflatable bladder adapted to receive the flexible open end of each container thereabout;

moving the movable chute assembly to alternately position each of said chutes in and out of position to receive a material from a material source;

while each of said chutes is out of position to receive material from the material source, placing the open end of one of the containers around the inflatable bladder disposed around the chute open end of each of said chutes, engaging a closure about the open end of the container, and inflating the inflatable bladder to secure the open end of the container to the chute open end of the respective chute; and while each of said chutes is in position to receive material from the material source, delivering material through the chute into the container secured to the chute open end of the respective chute; and after a predetermined amount of material has been delivered into the container, deflating the inflatable bladder disposed around the chute open end of the respective chute and disengaging the flexible end of the container to release the container from the chute open end of the respective chute so that said closure automatically closes the open end of the container in response to the container disengaging from the chute open end.

16. The method of claim 15 wherein the step of moving the movable chute assembly comprises moving the movable chute assembly alternately from a first position to at least a second position so that one of said chutes is disposed in registration with the source of material to receive material through said chute while in said first position, and another of said chutes is disposed in registration with the source of material to receive material through another chute while in said second position.

17. The method of claim 16 wherein said step of moving the moveable chute assembly comprises linearly translating the movable chute assembly selectively from said first position to said at least a second position.

18. The method of claim 16 wherein said step of moving the moveable chute assembly comprises rotating the movable chute assembly selectively from said first position to said at least a second position.

19. The method of claim 16 wherein:

the container comprises a flexible container body comprising a body sidewall and having a closed end and an open end defining a container opening, and the closure comprises a spring closure device engaged about the body sidewall adjacent the open end of the container body for urging the container open end into a closed position, said spring closure comprising first and second spring assemblies, said first spring assembly hingedly engaged with said second spring assembly, each spring assembly including first and second spring arms interconnected through an integral spring portion, the first and second spring arms being disposed in substantially parallel relation when said container is closed and capable of being angularly displaced when the container open end is urged into an open state, such that when the container is urged into an open state the container open end opening is substantially rectangular in shape.

20. A method for loading and closing a container having a flexible open end, comprising the steps of:

placing the open end of the container around an inflatable bladder disposed around an open end of a chute;

inflating the bladder disposed around the open end of the chute to engage the open end of the container and support the container about the chute open end;

placing a closure device around the open end of the container disposed about the chute;

delivering material through the chute into the container; and deflating the bladder to release the container from the chute, so that the closure device automatically closes the open end of the container in response to the container sliding off the open end of the chute.

21. A method for loading and closing a container having a flexible open end, comprising the steps of:

placing the open end of the container around an open end of a chute;

engaging a container retainer with the open end of the container disposed about the chute to support the container about the chute open end;

placing a closure device around the open end of the container disposed about the chute;

delivering material through the chute into the container; and disengaging the container retainer to release the container from the chute, so that the closure device automatically closes the open end of the container in response to the container sliding off the open end of the chute.

22. The method of claim 21 wherein the closure device is a spring closure device.

23. The method of claim 22 wherein said open end of said chute comprises a rectangular transverse cross-section shape; and, wherein said spring closure device comprises a plurality of leg assemblies comprising elongate legs pivotally engaged with one another, end-to-end, and including at least one closure spring engaged with at least two of the legs so as to urge the plurality of legs into parallel alignment with one another so as to close the container opening.

24. The method of claim 23 wherein the container retainer comprises an inflatable bladder, the step of engaging the container retainer comprises placing the inflatable bladder about said chute adjacent said open end and inflating said bladder to support said container about said chute while material is loaded into said container, and the step of disengaging the container retainer comprises deflating said bladder to allow said container to slide off of said chute.

* * * * *